US008693928B2

(12) United States Patent
Kawashima

(10) Patent No.: US 8,693,928 B2
(45) Date of Patent: Apr. 8, 2014

(54) DEVELOPMENT DEVICE AND IMAGE FORMATION APPARATUS

(75) Inventor: Junichi Kawashima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 118 days.

(21) Appl. No.: 13/298,568

(22) Filed: Nov. 17, 2011

(65) Prior Publication Data

US 2012/0134697 A1 May 31, 2012

(30) Foreign Application Priority Data

Nov. 25, 2010 (JP) ..... 2010-262855

(51) Int. Cl.
*G03G 15/08* (2006.01)

(52) U.S. Cl.
USPC ..... 399/284

(58) Field of Classification Search
USPC ..... 399/281, 284
See application file for complete search history.

(56) References Cited

U.S. PATENT DOCUMENTS

2005/0226659 A1* 10/2005 Ebe ..... 399/286
2005/0260007 A1* 11/2005 Shimomura ..... 399/55

FOREIGN PATENT DOCUMENTS

| | | | |
|---|---|---|---|
| JP | 2000-275953 | A | 10/2000 |
| JP | 2001-281982 | A | 10/2001 |
| JP | 2005-215057 | A | 8/2005 |
| JP | 2006-064922 | A | 3/2006 |
| JP | 2009-175372 | A | 8/2009 |
| JP | 2010-217707 | A | 9/2010 |

* cited by examiner

*Primary Examiner* — Walter L Lindsay, Jr.
*Assistant Examiner* — Barnabas Fekete
(74) *Attorney, Agent, or Firm* — Marvin A. Motsenbocker; Mots Law, PLLC

(57) ABSTRACT

A development device includes an image carrier configured to develop an electrostatic latent image by using a developer, a development member configured to supply the developer to the image carrier, a developer supply member configured to supply the developer onto a surface of the development member, and a developer restriction member including a contact portion configured to form a developer layer on the surface of the development member while being in contact with the surface. A curvature radius R [mm] of the contact portion of the developer restriction member is 0.17 [mm] to 0.28 [mm], both inclusive, and an ASKER F hardness [°] of the developer supply member is $181.82 \times R + 9.09 \leq F \leq -250 \times R + 130$.

32 Claims, 26 Drawing Sheets

PRINT PATTERN OF 5% DUTY

PRINT PATTERN OF 100% DUTY

PRINT PATTERN OF 40% DUTY

OCCURRENCE OF WHITE VERTICAL STRIPES
IN PRINT PATTERN OF 100% DUTY

EDGE PORTION OF DEVELOPMENT BLADE IN FIG. 1
WITH FIXED ADHESION OF FOREIGN OBJECTS

HIGH ASKER F HARDNESS
OF SUPPLY ROLLER

EDGE PORTION OF DEVELOPMENT BLADE IN FIG. 1
WITH FIXED ADHESION OF FOREIGN OBJECTS

LOW ASKER F HARDNESS
OF SUPPLY ROLLER

FIG. 12

RELATIONSHIP BETWEEN ASKER F HARDNESS OF SUPPLY ROLLER IN FIG. 1 AND SMEAR AFTER PRINTING OF 30,000 PAGES

| | ASKER F HARDNESS [°] | | | | |
|---|---|---|---|---|---|
| | 40 | 50 | 60 | 70 | 80 |
| WHITE VERTICAL STRIPE | × | △ | ○ | ○ | ○ |
| END PORTION SMEAR | ○ | ○ | ○ | △ | × |

FIG. 13

RELATIONSHIP BETWEEN DEVELOPMENT BLADE IN FIG. 1 AND SMEAR AFTER PRINTING OF 30,000 PAGES

| HARDNESS [°] | 40 | | | | | | 60 | | | | | |
|---|---|---|---|---|---|---|---|---|---|---|---|---|
| R [mm] | 0.17 | 0.20 | 0.23 | 0.25 | 0.27 | 0.30 | 0.17 | 0.20 | 0.23 | 0.25 | 0.27 | 0.30 |
| WHITE VERTICAL STRIPE | ○ | ○ | △ | × | × | × | ○ | ○ | ○ | ○ | × | × |
| END PORTION SMEAR | ○ | ○ | ○ | ○ | ○ | ○ | ○ | ○ | ○ | ○ | △ | × |

FIG. 14

ASKER F HARDNESS OF SUPPLY ROLLER IN FIG. 1 AND CURVATURE RADIUS R OF DEVELOPMENT BLADE IN FIG. 1

| ASKER HARDNESS [°] OF SUPPLY ROLLER | 35 | 40 | 50 | 55 | 60 | 65 | 70 | 75 | 85 | 85 |
|---|---|---|---|---|---|---|---|---|---|---|
| DEVELOPMENT BLADE R [mm] | 0.14 | 0.15 | 0.17 | 0.20 | 0.23 | 0.25 | 0.28 | 0.30 | – | – |

FIG. 15

COMBINATIONS OF ASKER F HARDNESS AND CURVATURE RADIUS R OF FIG. 14

| | | CURVATURE RADIUS R [mm] | | | | | | | |
|---|---|---|---|---|---|---|---|---|---|
| | | 0.14 | 0.15 | 0.17 | 0.20 | 0.23 | 0.25 | 0.28 | 0.30 |
| HARDNESS [°] | 35 | | | | | | | | |
| | 40 | | | | | | | | |
| | 45 | | | | | | | | |
| | 50 | | | | | | | | |
| | 55 | | | | | | | | |
| | 60 | | | | | | | | |
| | 65 | | | | | | | | |
| | 70 | | | | | | | | |
| | 75 | | | | | | | | |
| | 80 | | | | | | | | |
| | 85 | | | | | | | | |

DENSITY MEASUREMENT POSITIONS IN PRINT PATTERN OF 100% DUTY

FIG. 17

JUDGMENT RESULTS OF SMEARS FOR COMBINATIONS OF ASKER F HARDNESS AND CURVATURE RADIUS R OF FIG. 15

| | | CURVATURE RADIUS R [mm] | | | | | | | |
|---|---|---|---|---|---|---|---|---|---|
| | | 0.14 | 0.15 | 0.17 | 0.20 | 0.23 | 0.25 | 0.28 | 0.30 |
| HARDNESS [°] | 35 | ▲ | ▲ | △ | × | × | × | × | × |
| | 40 | ▲ | ▲ | ○ | △ | × | × | × | × |
| | 45 | ▲ | ▲ | ○ | △ | × | × | × | × |
| | 50 | ▲ | ▲ | ○ | ○ | △ | × | × | × |
| | 55 | ▲ | ▲ | ○ | ○ | ○ | ○ | △ | × |
| | 60 | ▲ | ▲ | ○ | ○ | ○ | ○ | ○ | △ |
| | 65 | ▲ | ▲ | ○ | ○ | ○ | ○ | △ | △ |
| | 70 | ▲ | ▲ | ○ | ○ | ○ | ○ | △ | × |
| | 75 | ▲ | ○ | ○ | ○ | ○ | △ | × | × |
| | 80 | ▲ | ○ | ○ | ○ | △ | × | × | × |
| | 85 | ▲ | ○ | ○ | × | × | × | × | × |

FIG. 19

CROWN RATIO OF SUPPLY ROLLER IN FIG. 1

| CROWN RATIO B OF SUPPLY ROLLER | 1.000 | 0.987 | 0.975 | 0.962 | 0.949 | 0.936 |
|---|---|---|---|---|---|---|
| CENTER NIP WIDTH [mm] | 3.17 | 3.44 | 3.70 | 3.97 | 4.23 | 4.50 |
| END PORTION NIP WIDTH [mm] | 4.99 | 4.84 | 4.68 | 4.53 | 4.37 | 4.22 |

FIG. 20

CROWN RATIO OF FIG. 19 AND OUTER DIAMETER CHANGE RATIO

| CROWN RATIO B OF SUPPLY ROLLER | 1.000 | 0.987 | 0.975 | 0.962 | 0.949 | 0.936 |
|---|---|---|---|---|---|---|
| RATIO OF OUTER DIAMETER OF END PORTIONS OF SUPPLY ROLLER AFTER PRINTING OF 30,000 PAGES / INITIAL OUTER DIAMETER | 0.974 | 0.978 | 0.982 | 0.986 | 0.990 | 0.995 |

FIG. 21

RELATIONSHIP BETWEEN CROWN RATIO OF FIG. 19 AND SMEAR

| | CROWN RATIO B | | | | | |
|---|---|---|---|---|---|---|
| | 1.000 | 0.987 | 0.975 | 0.962 | 0.949 | 0.936 |
| WHITE VERTICAL STRIPE | × | × | △ | ○ | ○ | ○ |
| END PORTION SMEAR | × | × | △ | ○ | ○ | ○ |

FIG. 22

JUDGMENT RESULTS OF SMEARS FOR COMBINATIONS OF ASKER F HARDNESS AND CURVATURE RADIUS R WHEN L1 / L2 = 0.962

| | | CURVATURE RADIUS R [mm] | | | | | | | |
|---|---|---|---|---|---|---|---|---|---|
| | | 0.14 | 0.15 | 0.17 | 0.20 | 0.23 | 0.25 | 0.28 | 0.30 |
| HARDNESS [°] | 35 | ▲ | ▲ | ○ | × | × | × | × | × |
| | 40 | ▲ | ▲ | ○ | ○ | × | × | × | × |
| | 45 | ▲ | ▲ | ○ | ○ | ○ | × | × | × |
| | 50 | ▲ | ▲ | ○ | ○ | △ | × | × | × |
| | 55 | ▲ | ▲ | ○ | ○ | ○ | ○ | △ | × |
| | 60 | ▲ | ▲ | ○ | ○ | ○ | ○ | ○ | △ |
| | 65 | ▲ | ▲ | ○ | ○ | ○ | ○ | ○ | △ |
| | 70 | ▲ | ▲ | ○ | ○ | ○ | ○ | △ | × |
| | 75 | ▲ | ○ | ○ | ○ | ○ | ○ | × | × |
| | 80 | ▲ | ○ | ○ | ○ | △ | △ | × | × |
| | 85 | ▲ | ○ | ○ | ○ | × | × | × | × |

JUDGMENT RESULTS OF SMEARS FOR COMBINATIONS OF ASKER F HARDNESS AND CURVATURE RADIUS R OF FIG. 22

FIG. 24

RELATIONSHIP BETWEEN PARTIAL RESISTANCE VALUE OF SUPPLY ROLLER IN FIG. 1 AND SMEAR

| | PARTIAL RESISTANCE VALUE [log Ω] | | | | | | | | |
|---|---|---|---|---|---|---|---|---|---|
| | 5.0 | 5.5 | 6.0 | 6.5 | 7.0 | 7.5 | 8.0 | 8.5 | 9.0 |
| WHITE VERTICAL STRIPE | ○ | ○ | ○ | ○ | ○ | ○ | ○ | △ | × |
| END PORTION SMEAR | × | × | △ | ○ | ○ | ○ | ○ | ○ | ○ |

FIG. 25

JUDGMENT RESULTS OF SMEARS FOR COMBINATIONS OF ASKER F HARDNESS AND CURVATURE RADIUS R WITH A [log Ω] = 8.0 [log Ω]

| | | CURVATURE RADIUS R [mm] | | | | | | | |
|---|---|---|---|---|---|---|---|---|---|
| | | 0.14 | 0.15 | 0.17 | 0.20 | 0.23 | 0.25 | 0.28 | 0.30 |
| HARDNESS [°] | 35 | ▲ | ▲ | ○ | △ | × | × | × | × |
| | 40 | ▲ | ▲ | ○ | ○ | × | × | × | × |
| | 45 | ▲ | ▲ | ○ | ○ | × | × | × | × |
| | 50 | ▲ | ▲ | ○ | ○ | ○ | ○ | × | × |
| | 55 | ▲ | ▲ | ○ | ○ | ○ | ○ | △ | × |
| | 60 | ▲ | ▲ | ○ | ○ | ○ | ○ | ○ | △ |
| | 65 | ▲ | ▲ | ○ | ○ | ○ | ○ | ○ | ○ |
| | 70 | ▲ | ▲ | ○ | ○ | ○ | ○ | △ | × |
| | 75 | ▲ | ○ | ○ | ○ | ○ | ○ | × | × |
| | 80 | ▲ | ○ | ○ | ○ | ○ | △ | × | × |
| | 85 | ▲ | ○ | ○ | ○ | × | × | × | × |

CONTROL SEQUENCE OF BIAS VOLTAGE VALUES SB AND DB APPLIED IN THE APPARATUS SHOWN IN FIG. 27

FIG. 29

RELATIONSHIP BETWEEN SB-DB VALUE AND SMEAR

| | SB-DB [V] | | | | | | | | |
|---|---|---|---|---|---|---|---|---|---|
| | -25 | -50 | -75 | -100 | -125 | -150 | -175 | -200 | -225 |
| WHITE VERTICAL STRIPE | × | △ | ○ | ○ | ○ | ○ | ○ | ○ | ○ |
| END PORTION SMEAR | ○ | ○ | ○ | ○ | ○ | ○ | △ | × | × |

FIG. 30

RELATIONSHIP BETWEEN ENVIRONMENT TEMPERATURE AND SMEAR

| | TEMPERATURE [°C] | | | | | | | | |
|---|---|---|---|---|---|---|---|---|---|
| | 4 | 8 | 12 | 16 | 20 | 24 | 28 | 32 | 36 |
| WHITE VERTICAL STRIPE | ○ | ○ | ○ | ○ | ○ | △ | × | × | × |

FIG. 31

RELATIONSHIP BETWEEN ENVIRONMENT TEMPERATURE AND SB CORRECTION VALUE

| | TEMPERATURE [°C] | | | | | | | | |
|---|---|---|---|---|---|---|---|---|---|
| | 4 | 8 | 12 | 16 | 20 | 24 | 28 | 32 | 36 |
| SB CORRECTION VALUE D | 0 | 0 | 0 | 0 | -10 | -20 | -30 | -40 | -50 |

FIG. 32

COMBINATIONS OF CURVATURE RADIUS R OF DEVELOPMENT BLADE AND HARDNESS OF SUPPLY ROLLER

| R [mm] | 0.18 | 0.20 | 0.22 | 0.24 | 0.26 | 0.28 |
|---|---|---|---|---|---|---|
| HARDNESS [°] | 38 | 41 | 44 | 50 | 55 | 61 |

FIG. 33

SMEARS UNDER COMBINATIONS OF FIG. 32 WITHOUT SB-DB CONTROL SEQUENCE

| R [mm] | | 0.18 | 0.20 | 0.22 | 0.24 | 0.26 | 0.28 |
|---|---|---|---|---|---|---|---|
| HARDNESS [°] | | 38 | 41 | 44 | 50 | 55 | 61 |
| TEMPERATURE | 16 °C | ○ | ○ | ○ | ○ | ○ | ○ |
| | 28 °C | × | × | △ | ○ | ○ | ○ |
| | 36 °C | × | × | × | △ | △ | ○ |

FIG. 34

SMEARS UNDER COMBINATIONS OF FIG. 32 WITH SB-DB CONTROL SEQUENCE

| R [mm] | | 0.18 | 0.20 | 0.22 | 0.24 | 0.26 | 0.28 |
|---|---|---|---|---|---|---|---|
| HARDNESS [°] | | 38 | 41 | 44 | 50 | 55 | 61 |
| TEMPERATURE | 16 °C | ○ | ○ | ○ | ○ | ○ | ○ |
| | 28 °C | ○ | ○ | ○ | ○ | ○ | ○ |
| | 36 °C | ○ | ○ | ○ | ○ | ○ | ○ |

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2010-262855 filed on Nov. 25, 2010, entitled "DEVELOPMENT DEVICE AND IMAGE FORMATION APPARATUS", the entire contents of which are incorporated herein by reference.

BACKGROUND OF THE INVENTION

1. Field of the Invention

The present disclosure relates to a development device and an image formation apparatus using the development device.

2. Description of Related Art

An image formation apparatus, such as an electrophotographic page printer, conventionally includes a development device configured to form a visible image by developing an electrostatic latent image formed on a surface of a photosensitive drum by use of toner.

The development device is configured to be replaceable in the image formation apparatus. The development device includes a development roller as a developer carrier, a supply roller configured to supply toner as developer to the development roller, a development blade configured to form the toner supplied on the development roller into a thin layer, a photosensitive drum as a latent image carrier, a charge roller configured to negatively charge the photosensitive drum, and the like (for example, Japanese Patent Application Publication No. 2006-64922).

However, the conventional development device or the conventional image formation apparatus may have a deterioration of an image quality over time.

SUMMARY OF THE INVENTION

A first aspect of the present invention is a development device that includes: an image carrier configured to develop an electrostatic latent image by using a developer; a development member configured to supply the developer to the image carrier; a developer supply member configured to supply the developer onto a surface of the development member; and a developer restriction member including a contact portion configured to form a developer layer on the surface of the development member while being in contact with the surface. A curvature radius R [mm] of the contact portion of the developer restriction member is 0.17 [mm] to 0.28 [mm], both inclusive. An ASKER F hardness [°] of the developer supply member is $181.82\times R+9.09\leq F\leq -250\times R+130$.

A second aspect of the present invention is an image formation apparatus that includes: the development device of the first aspect; a conveyance mechanism configured to convey a record medium; a transfer portion configured to transfer the developer visualized by the developer device to the record medium; and a fuse portion configured to fuse the developer transferred to the record medium.

According to the aspects described above, an image quality deterioration, such as a white vertical stripe and an end portion smear, over time can be reduced.

BRIEF DESCRIPTION OF THE DRAWINGS

FIG. 12 is a table showing the relationship between the ASKER F hardness of the supply roller in FIG. 1 and smear after printing 30,000 pages.

FIG. 13 is a table showing the relationship between a curvature radius R of the development blade in FIG. 1 and smear after printing 30,000 pages.

FIG. 14 is a table showing the relationship between ASKER F hardness of the supply roller in FIG. 1 and the curvature radius R of the development blade in FIG. 1.

FIG. 15 is a table listing possible combinations of the curvature radius R and the ASKER F hardness of FIG. 14.

FIG. 17 is a table showing judgment results of smears for each combination of the curvature radius R and the ASKER F hardness of FIG. 14.

FIG. 19 is a table showing the relationship between the crown ratio of the supply roller in FIG. 1 and nip widths [mm].

FIG. 20 is a table showing the relationship between crown ratios B of FIG. 19 and change ratio of the outer diameter of the supply roller.

FIG. 21 is a table showing the relationship between the crown ratio of FIG. 19 and the smears.

FIG. 22 is a table showing judgment results of smears for combinations of the ASKER F hardness and the curvature radius R when L1/L2=0.962.

FIG. 24 is a table showing the relationship between a partial resistance value of the supply roller in FIG. 1 and the smears.

FIG. 25 is a table showing judgment results of smears for combinations of the ASKER F hardness and the curvature radius R when A [log Ω]=8.0 [log Ω].

FIG. 29 is a table showing the relationship between the SB-DB bias voltage values as applied to the block diagram of FIG. 27 and the smears.

FIG. 30 is a table showing the relationship between environment temperature in FIG. 27 and the smear.

FIG. 31 is a table showing the relationship between the environment temperature in FIG. 27 and a SB correction value.

FIG. 32 is a table showing combinations of the curvature radius R of the development blade and the ASKER F hardness of the supply roller used in the block diagram of FIG. 27.

FIG. 33 is a table showing judgment results of the smear in each of the combinations of FIG. 32 without SB-DB control sequence.

FIG. 34 is a table showing judgment results of the smear in each of the combinations of FIG. 32 with SB-DB control sequence.

DETAILED DESCRIPTION OF EMBODIMENTS

Figure 1:
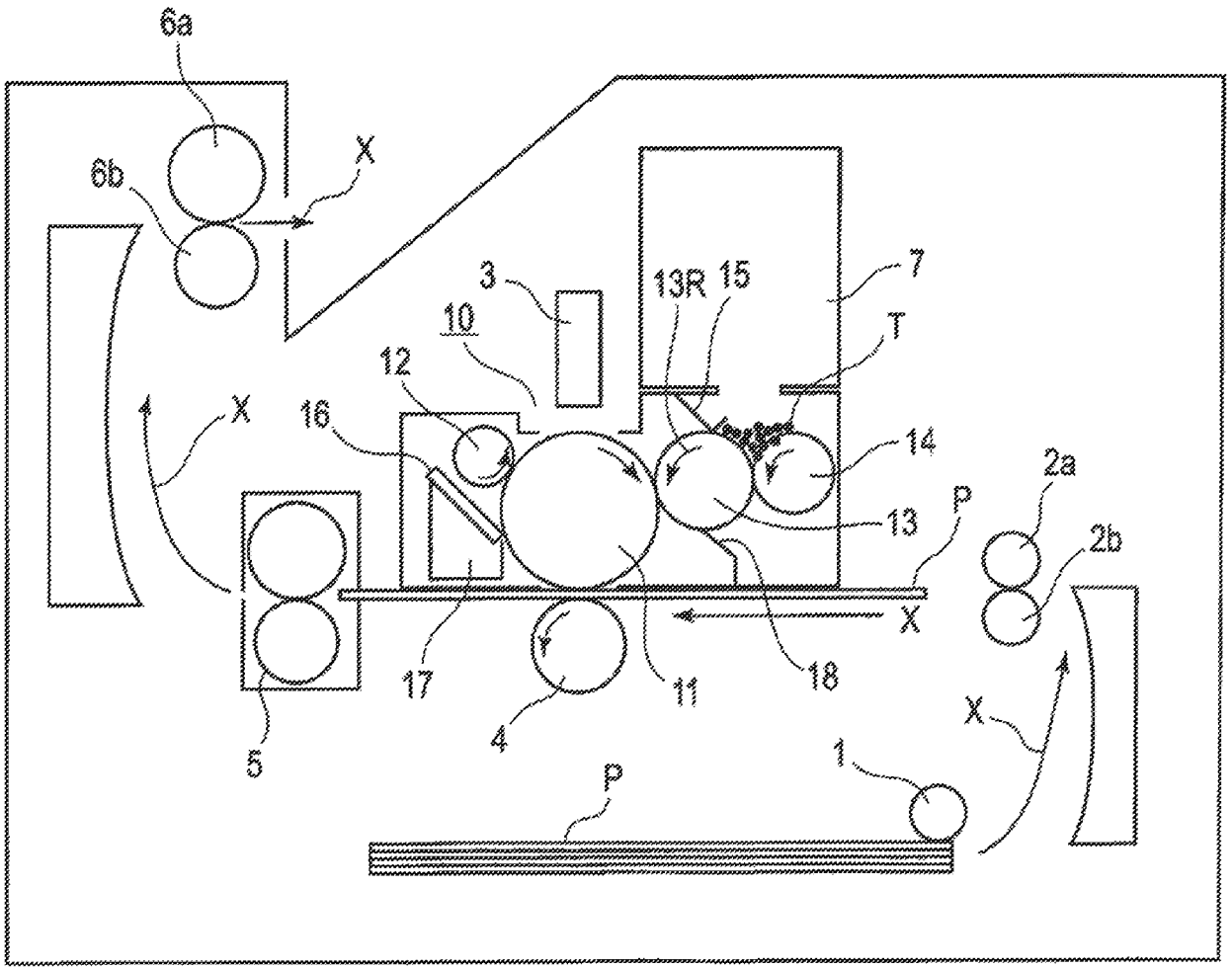
FIG. 1 is a view schematically illustrating a configuration of an image formation apparatus of Embodiment 1 of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiment 1

Configuration of Embodiment 1

FIG. 1 is a view schematically illustrating a configuration of an image formation apparatus of Embodiment 1 of the invention.

The image formation apparatus is, for example, an electrophotographic page printer, and includes development device 10 configured to form a visible image (hereinafter, referred to as "toner image") by developing an electrostatic latent image formed on a surface of image carrier (for example, photosensitive drum) 11 by use of developer (for example, toner) T.

Development device 10 includes photosensitive drum 11 configured to carry the electrostatic latent image, charge roller 12 configured to charge photosensitive drum 11, development member (for example, development roller) 13 rotatably disposed in contact with photosensitive drum 11, developer supply member (for example, supply roller) 14 configured to supply toner T to development roller 13, developer restriction member (for example, development blade or developer metering member) 15 configured to form a thin layer of toner T supplied onto a surface of development roller 13, cleaning blade 16 configured to collect residual toner T on the surface of photosensitive drum 11, space 17 configured to house members such as a screw used to convey waste toner T scraped off by cleaning blade 16 to a collection container, seal member 18 configured to prevent toner T from leaking to the outside of development device 10.

An inside of development device 10 is filled with toner T supplied from toner cartridge 7. Photosensitive drum 11, charge roller 12, development roller 13, and supply roller 14 are configured to rotate in directions of arrows shown in FIG. 1, respectively.

Light emitting diode (hereinafter, referred to as "LED") head 3 is an exposure device configured to form the electrostatic latent image on photosensitive drum 11. Transfer roller 4 is configured to transfer a toner image formed on photosensitive drum 11 to a record medium P (for example, a paper sheet) and is disposed below photosensitive drum 11. Transfer roller 4 rotates in the direction of the arrow as shown in FIG. 1.

Figure 2A:
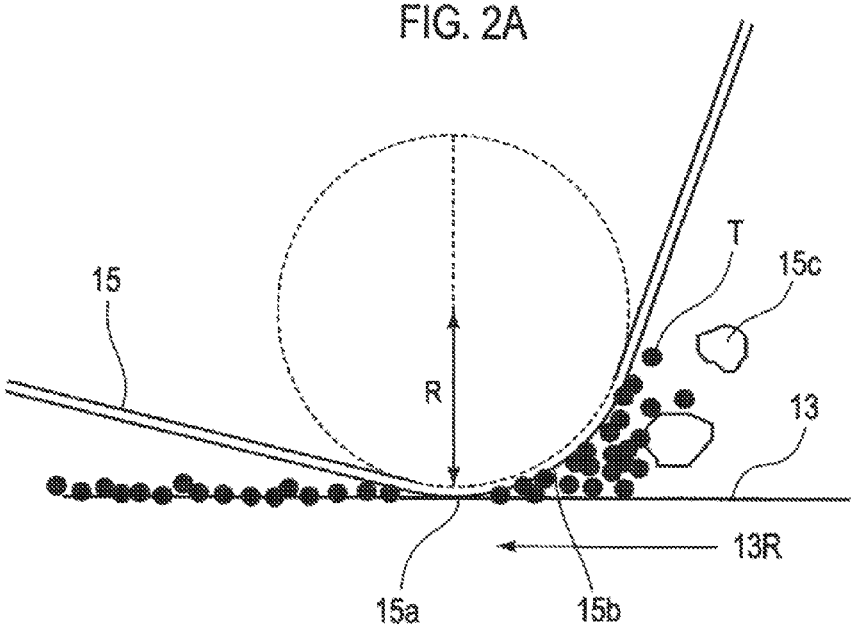
FIGS. 2A and 2B are views illustrating a contact portion between the development blade and the development roller in FIG. 1.
Figure 2B:
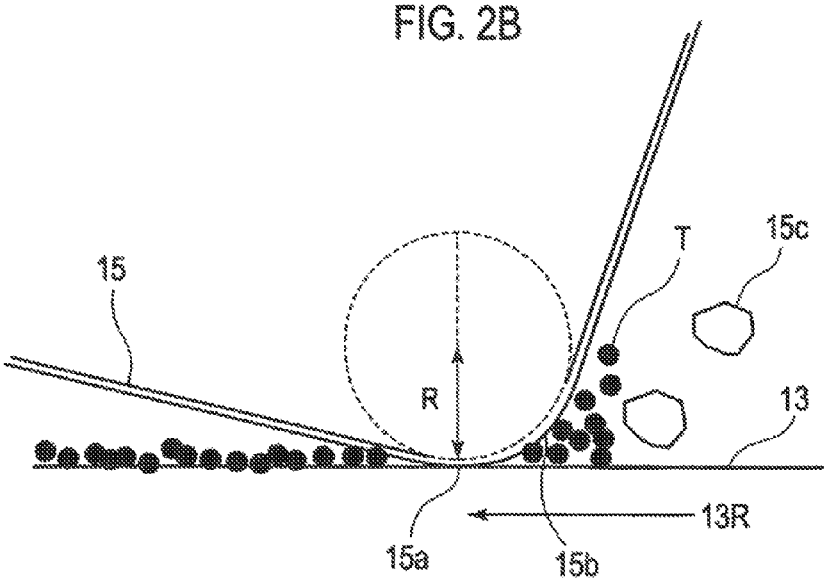

FIGS. 2A and 2B are views illustrating contact portion 15*a* between development blade 15 and development roller 13 in FIG. 1.

Development blade 15 has the function of making the thickness of a toner layer uniform by scraping off excessive toner T on development roller 13 when the toner layer is to be formed on the surface of development roller 13. Development blade 15 is formed by bending an elastic member, such as a plate-shaped metal sheet, into an almost L-shape so that toner T can be scraped off more easily. The bent portion, i.e. an edge portion, is configured to be pressed onto development roller 13. Furthermore, the edge portion of development blade 15 and development roller 13 are configured to come into contact with each other at contact portion 15*a* which is downstream of apex 15*b* of the edge portion in rotation direction 13R of development roller 13.

Figure 3:
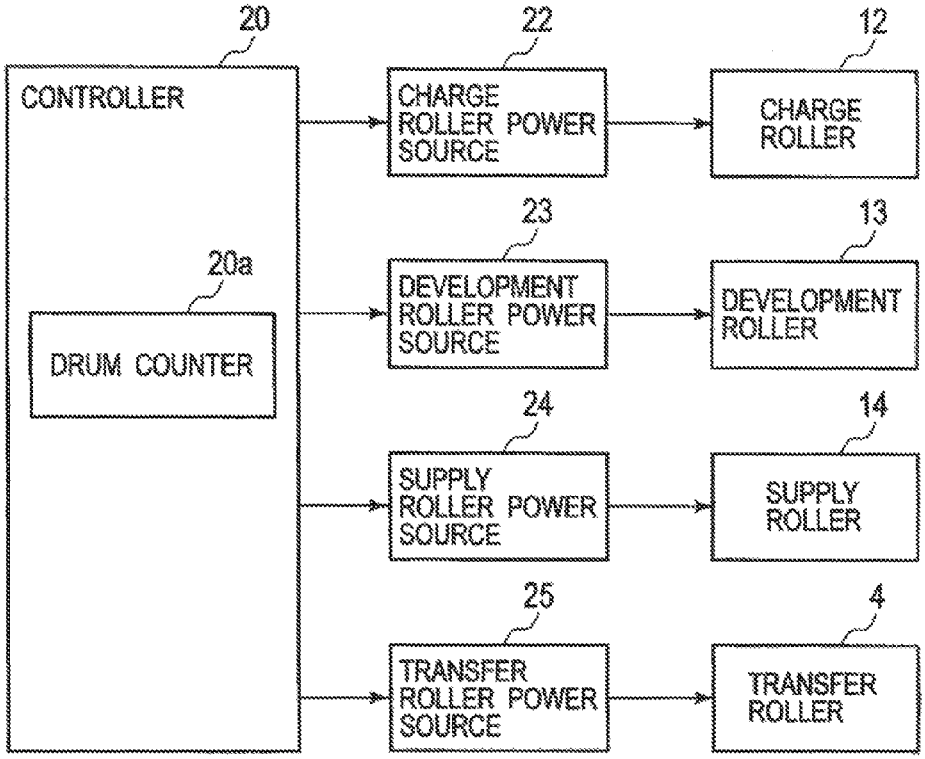
FIG. 3 is a block diagram illustrating components of the image formation apparatus of FIG. 1.

FIG. 3 is a block diagram of the image formation apparatus of FIG. 1.

The image formation apparatus includes controller 20 configured to control the entire apparatus by executing various programs stored in a read-only memory (ROM) (not illustrated) by use of a microprocessor and the like. Controller 20 includes drum counter 20*a* configured to count the number of rotations of photosensitive drum 11.

Charge roller power source 22 is configured to apply a predetermined voltage to charge roller 12. Development roller power source 23 is configured to apply a predetermined voltage to development roller 13. Supply roller power source 24 is configured to apply a predetermined voltage to supply roller 14, and transfer roller power source 25 is configured to apply a predetermined voltage to transfer roller 4. Each roller power source is connected to controller 20.

These power sources are configured to apply the predetermined voltages to charge roller 12, development roller 13, supply roller 14 and transfer roller 4 at respective predetermined timings in accordance with a control of controller 20, in such a way that the electrostatic latent image is developed to thereby form a toner image and the toner image is transferred onto paper sheet P.

Figure 4A:
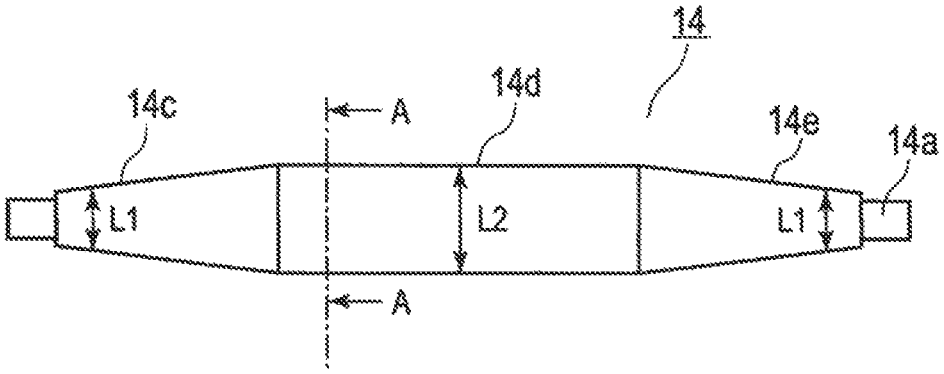
FIGS. 4A and 4B are views schematically illustrating a configuration of the supply roller in FIG. 1.
Figure 4B:
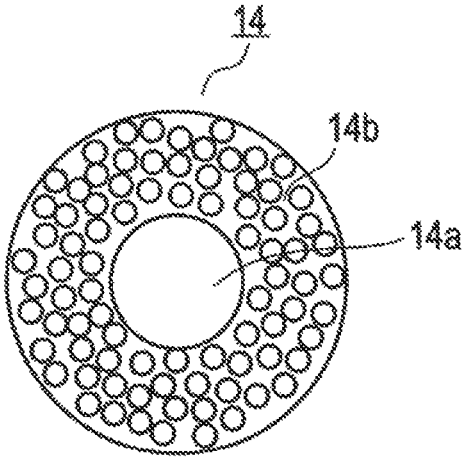

FIGS. 4A and 4B are views schematically illustrating a configuration of supply roller 14 in FIG. 1.

FIG. 4A is a front view of supply roller 14, and FIG. 4B is a cross sectional view taken along the line A-A in FIG. 4A.

In FIG. 4B, supply roller 14 consists of conductive shaft (metal core) 14*a* and elastic layer 14*b*. Conductive shaft 19*a* is formed by subjecting a SUM material to electroless nickel plating. Elastic layer 14*b* consists of a conductive silicone rubber foam layer. The density of the foam layer differs depending on an expansion ratio and an average cell size, and is preferably 100 to 400 [kg/m$^3$].

The expansion ratio of elastic layer 14*b* is 5 to 7 times, and the cell size thereof is 200 to 500 [μm]. The expansion ratio and the cell size are changed depending on an ASKER F hardness [°]. Furthermore, carbon black is added to elastic layer 14*b* as a conductive agent, and a partial resistance value [log Ω] is adjusted to be within a range of 5 [log Ω] to 9 [log Ω]. In Embodiment 1, the partial resistance value [log Ω] is 7 [log Ω].

Note that the partial resistance value [log Ω] of supply roller 14 is a resistance value measured in the following way. Specifically, multiple ball bearings each having an outer diameter of 6 [mm] and a width of 1.5 [mm] are arranged at equal intervals in a longitudinal direction of supply roller 14. Then, the resistance value is measured while the ball bearings are pressed against a surface of supply roller 14 at a pressure of 10.8 [gf] and a voltage of DC −300 [V] is applied between the ball bearings and the conductive shaft 14*a*.

The overall shape of supply roller 14 is an almost column shape as shown in FIG. 4A. The supply roller has a crown shape in which outer diameter L1 of end portions 14*c*, 14*e* in the longitudinal direction are smaller than outer diameter L2 of center portion 14*d*. In Embodiment 1, a crown ratio, which is a ratio of outer diameter L1 of end portions 14*c*, 14*e* to outer diameter L2 of center portion 14*d*, is about 0.975. Moreover, the hardness of elastic layer 14*b* is set at 40 [°] to 80 [°] in ASKER F hardness.

Note that the ASKER F is one type of durometers (spring-type hardness meters) defined in SIRIS 0101 (standards made by the society of the rubber industry, Japan), and is a measurement device for measuring hardness. The ASKER F hardness [°] is a hardness measured by using such a measurement device.

Figure 5:
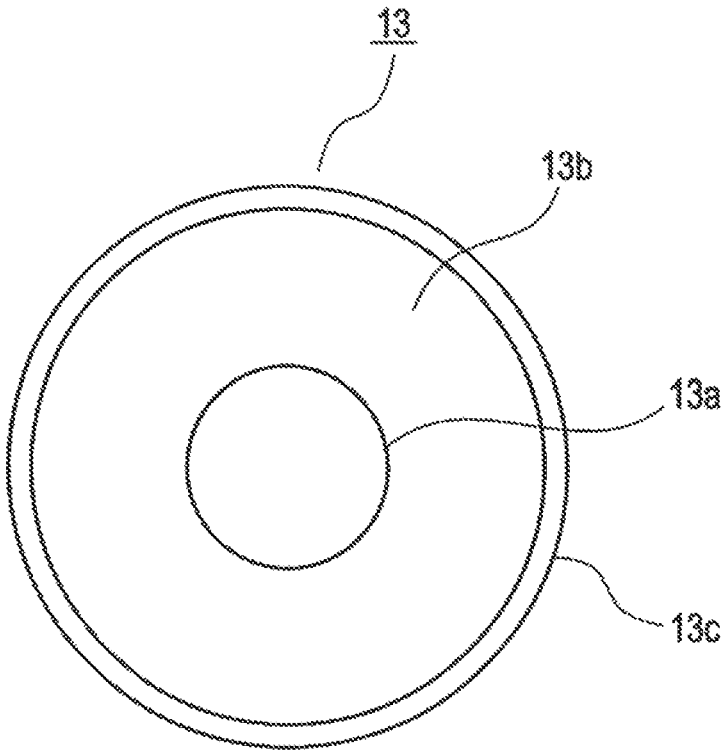
FIG. 5 schematically illustrates a configuration of the development roller in FIG. 1.

FIG. 5 is a view schematically illustrating a configuration of development roller 13 in FIG. 1.

Although not illustrated, development roller 13 has an almost cylindrical shape. FIG. 5 schematically illustrates a cross section of development roller 13 cut in a circumferential direction. The development roller 13 includes conductive shaft (metal core) 13*a* made of a SUM material, elastic layer 13*b* made of a polyurethane rubber, and a process layer 13*c* formed by subjecting a surface of elastic layer 13*b* to a process using an electrification agent, a surface modifier, and the like. In Embodiment 1, a polyurethane solution is used as a process liquid. The external shape of development roller 13 used in Embodiment 1 is a straight shape, and a ten-point mean roughness Rz (JIS B0601-1994) of the roller surface is about 2 to 6 [μm].

Note that the ten-point mean roughness Rz refers to a value obtained as follows. First, a section having a length equal to a reference length is extracted from a roughness curve in the direction of a mean line. Then, the sum of the average value of absolute values of heights (Yp) of the five highest peaks, and the average value of absolute values of depths (Yv) of the five deepest valleys, is obtained. The heights and depths are measured from a mean line of the extracted section in a vertical magnification direction. The value thus obtained is expressed in micrometers [μm].

Operation of Embodiment 1

An operation of Embodiment 1 is described with reference to FIGS. 1 to 3.

When the image formation apparatus is turned on, an instruction of controller 20 causes charge roller power source 22, development roller power source 23, supply roller power source 24, and transfer roller power source 25 to apply the predetermined voltages respectively to charge roller 12, development roller 13, supply roller 14, and transfer roller 4, and causes the rollers to start rotating. At the same time, power is supplied also to drive motors for hopping roller 1, a pair of paper sheet conveyance rollers 2*a*, 2*b*, and the like.

Paper sheet P is fed out by hopping roller 1, conveyed in a direction of medium conveyance direction X by the pair of paper sheet conveyance rollers 2*a*, 2*b*, and reaches development device 10. In development device 10, photosensitive drum 11 is charged with a negative high voltage by charge roller 12. LED head 3 forms an electrostatic latent image on photosensitive drum 11 on the basis of imager data sent from a host apparatus (not illustrated).

Supply roller 14 rotates in contact with development roller 13, and supplies toner T supplied from toner cartridge 7 to development roller 13. Development blade 15 is in contact with development roller 13. Development blade 15 scrapes off excessive toner T on development roller 13 to make the thickness of toner T uniform, and at the same time charges toner T.

As shown in FIGS. 2A and 2B, the edge portion of development blade 15 and development roller 13 are in contact with each other at contact portion 15*a* which is downstream of apex 15*b* of the edge portion in rotation direction 13R of development roller 13.

In a portion near contact portion 15*a*, the larger a curvature radius R [mm] of contact portion 15*a* is, the more likely it is that foreign object 15*c*, such as a piece of worn-out supply roller 14 or a lump of solidified toner T, fixedly adheres to the edge portion. For example, contact portion 15*a* of FIG. 2A has a larger curvature radius R [mm] than that of FIG. 2B. Thus, in FIG. 2A, foreign object 15*c* is more likely to fixedly adhere than in FIG. 2B. Note that, in Embodiment 1, the curvature radius R [mm] of contact portion 15*a* is set at 0.25 [mm].

Development roller 13 with toner T adhering thereto rotates in contact with photosensitive drum 11. Thus, the electrostatic latent image on photosensitive drum 11 is developed and the toner image is formed. A positive high voltage is applied to transfer roller 4, and the formed toner image is thus transferred to paper sheet P by a Coulomb force. The transferred toner image is fused to paper sheet P by fuser 5. Paper sheet P, to which the toner image is fused, is discharged to the outside by a pair of paper sheet conveyance rollers 6*a*, 6*b*.

Evaluation of Print Smears in Embodiment 1

The following three sections (1) Evaluation 1 to (3) Evaluation 3 provide descriptions of evaluations on relationships of the curvature radius R [mm] of development blade 15 of FIG. 1 and the ASKER F hardness [°] of supply roller 14 with occurrences of white vertical stripe P1 and end portion smear P2.

(1) Evaluation 1

Figure 6:
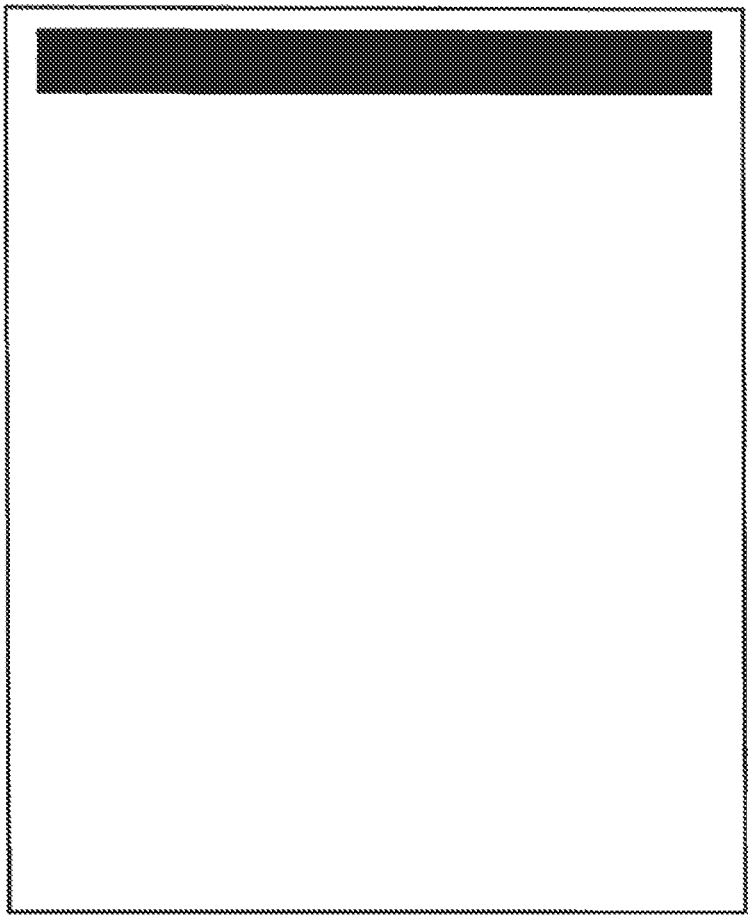
FIG. 6 is a view illustrating a print pattern of 5% duty.

FIG. 6 is a view illustrating a print pattern of 5% duty.

5% duty means that 5% of dots in a bitmap image of image data to be printed are printed.

Figure 7:
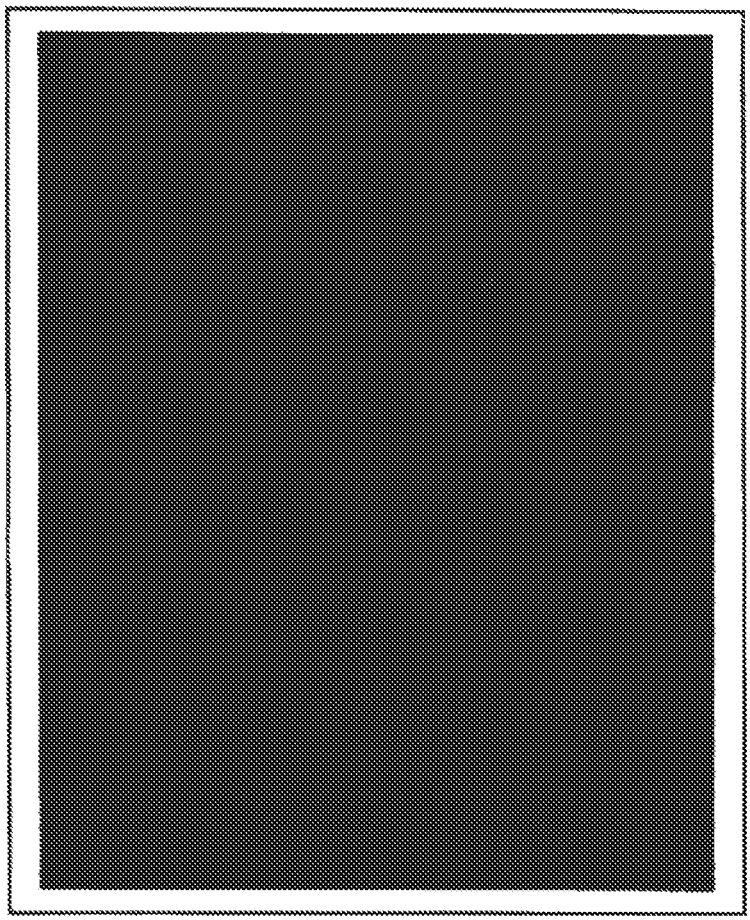
FIG. 7 is a view illustrating a print pattern of 100% duty.

FIG. 7 is a view illustrating a print pattern of 100% duty.

100% duty means solid printing in which all of the dots in the bitmap image of the image data are printed.

Figure 8:
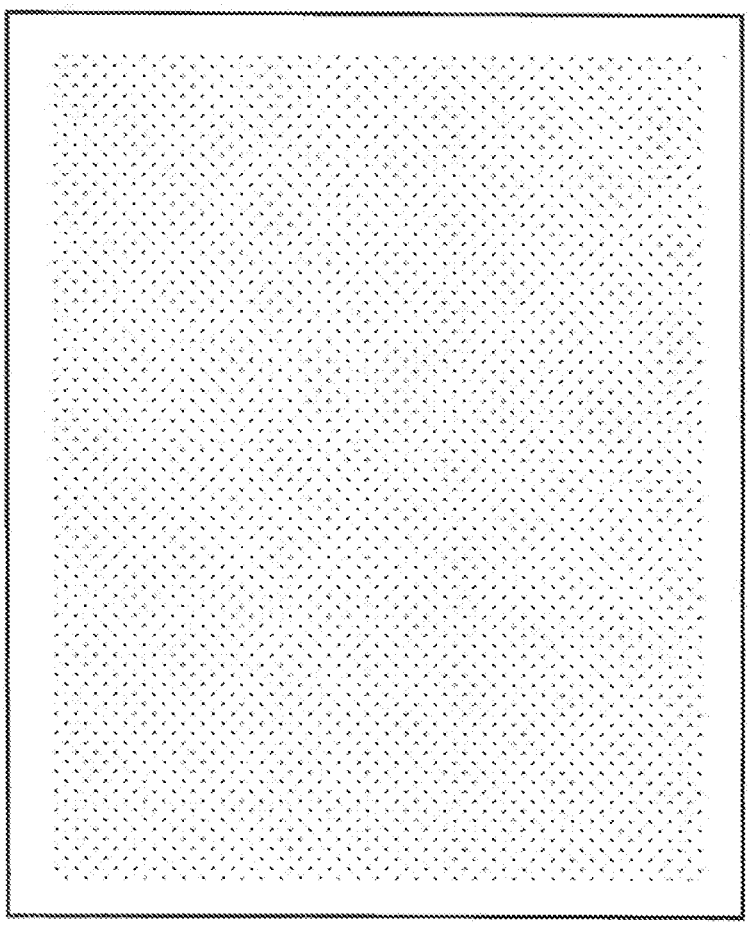
FIG. 8 is a view illustrating a print pattern of 40% duty.

FIG. 8 is a view illustrating a print pattern of 40% duty.

FIG. 8 illustrates a half tone printing in which 40% of the dots in the bitmap image of the image data are printed.

Figure 9:
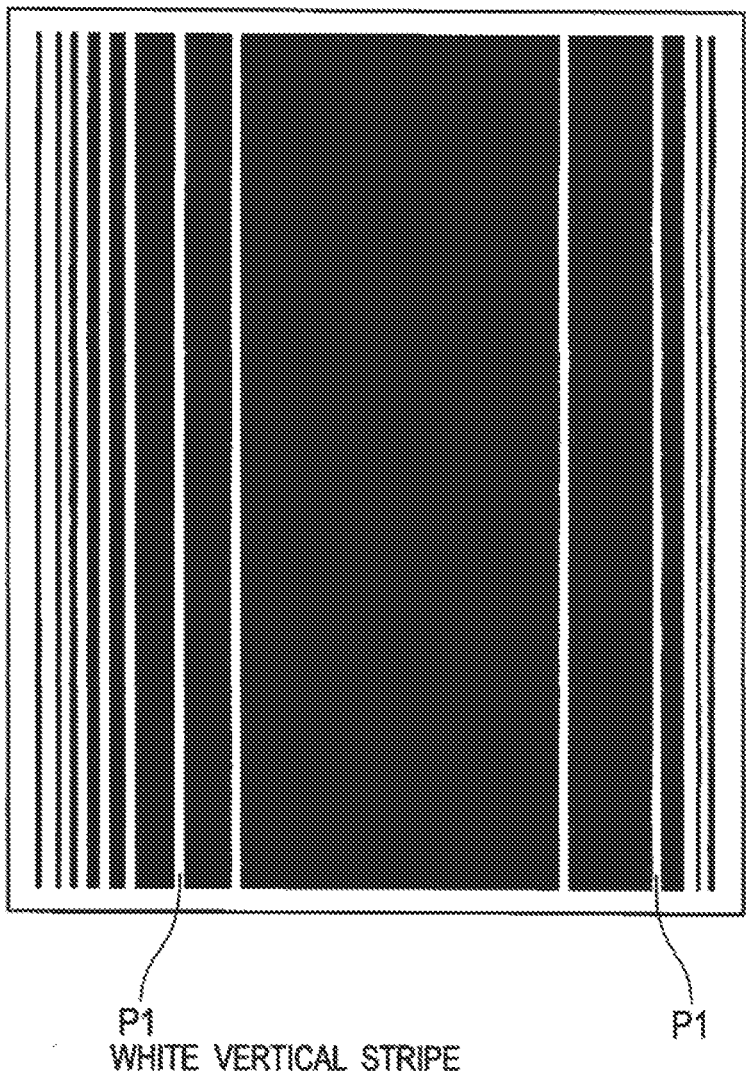
FIG. 9 is a view illustrating an occurrence of white vertical stripes in the print pattern of 100% duty.

FIG. 9 is a view illustrating an occurrence of white vertical stripes P1 in the print pattern of 100% duty.

FIG. 9 illustrates white vertical stripe P1 which occurs when the print pattern of 100% duty shown in FIG. 7 is printed after printing 30,000 pages of the print pattern of 5% duty shown in FIG. 6.

Figure 10A:
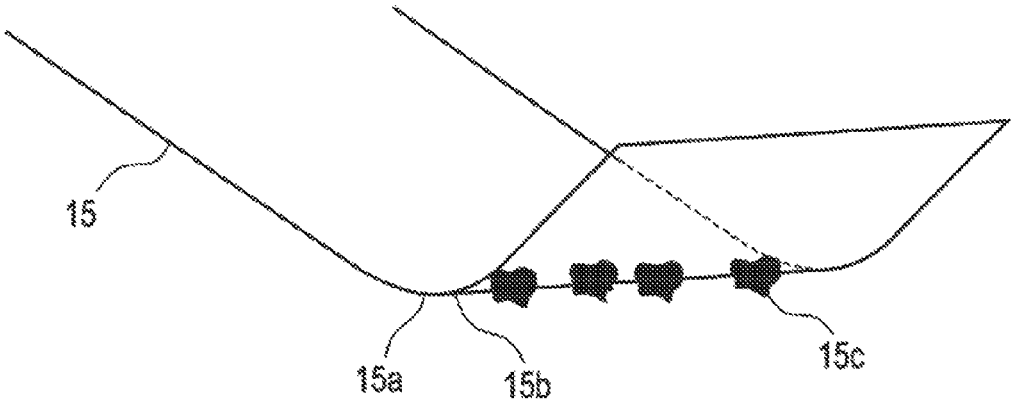
FIGS. 10A and 10B each illustrates a state where foreign objects fixedly adhere to an edge portion of the development blade in FIG. 1.
Figure 10B:
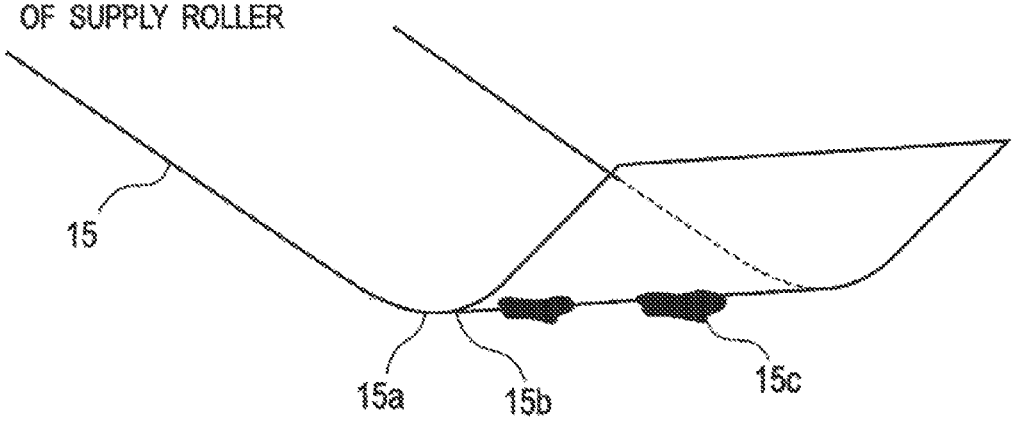

FIGS. 10A and 10B are each a view illustrating a state where foreign objects 15*c* fixedly adhere to the edge portion of development blade 15 in FIG. 1.

From FIGS. 10A and 10B, a comparison can be made of the sizes of foreign objects 15*c* adhering to the portion near contact portion 15*a* of development blade 15 after printing 30,000 pages of the print pattern of 5% duty shown in FIG. 6. FIG. 10A illustrates the case where the ASKER F hardness [°] of supply roller 14 is high, i.e. the case where supply roller 14 with hard elastic layer 14*b* is used. In FIG. 10A, the sizes of foreign objects 15*c* are generally smaller than those of FIG. 10B. FIG. 10B illustrates the case where the ASKER F hardness [°] of supply roller 14 is low, i.e. the case where supply roller 14 with soft elastic layer 14*b* is used. In FIG. 10B, the sizes of foreign objects 15*c* are generally larger than those of FIG. 10A.

Specifically, when the initial ASKER F hardness [°] of supply roller 14 is 50[°], many of the foreign objects 15*c* have a diameter of 200 to 600 [μm], and are large. Meanwhile, when the initial ASKER F hardness [°] of supply roller 14 is 70[°], although the number of foreign objects 15*c* is large, the diameter of each foreign object 15*c* is about 50 to 150 [μm].

Thus, the lower the initial ASKER F hardness [°] of supply roller 14 is, the larger the sizes of foreign objects 15*c* stuck in the portion near contact portion 15*a* of development blade 15 is. Thus, white vertical stripes P1 are more noticeable.

Figure 11:
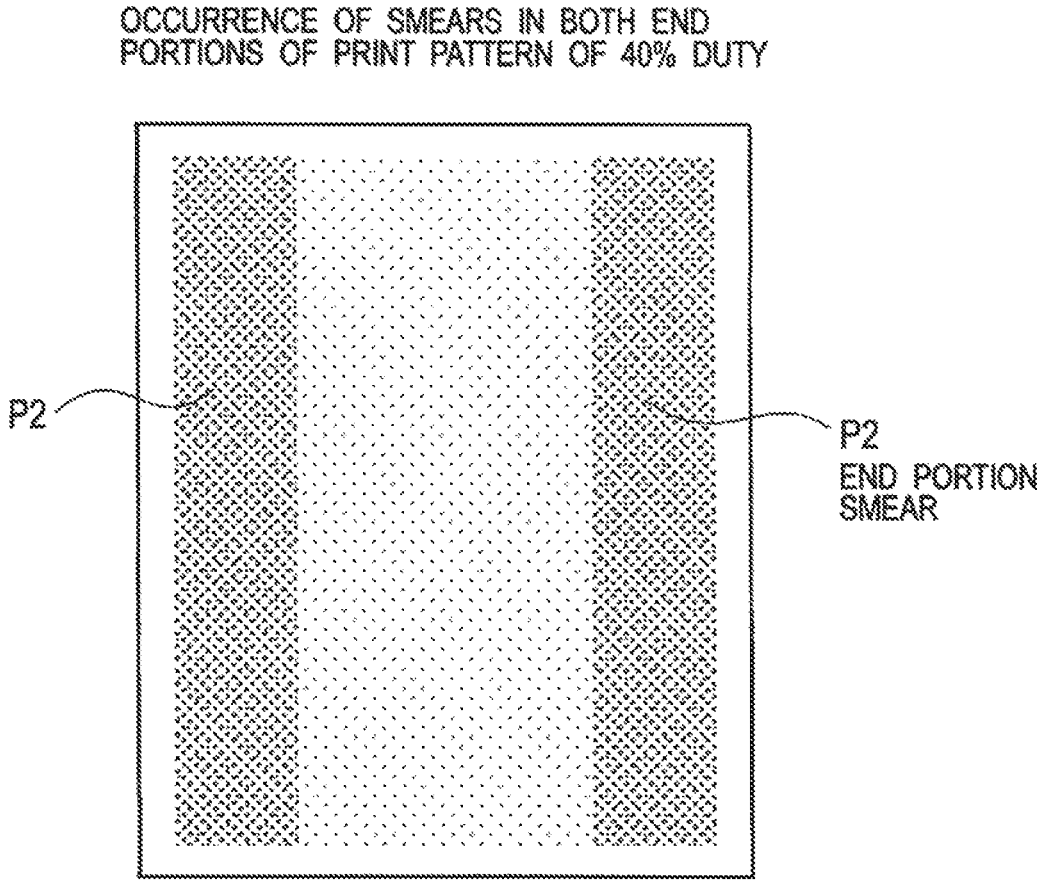
FIG. 11 is a view illustrating an occurrence of smears in both end portions of the print pattern of 40% duty.

FIG. 11 is a view showing an occurrence of smears in both end portions of the print pattern of 40% duty.

FIG. 11 shows that smears occur in both end portion of an image of the half tone pattern of 40% duty printed after printing 30,000 pages of the print pattern of 5% duty shown in FIG. 6.

FIG. 12 is a table showing the relationship between the ASKER F hardness [°] of supply roller 14 in FIG. 1 and smears after printing 30,000 pages.

FIG. 12 shows occurrence statuses of white vertical stripe P1 and end portion smear P2 for each of the cases where the ASKER F hardness [°] of supply roller 14 is 40[°], 50[°], 60[°], 70[°], and 80[°]. Here, white vertical stripe P1 is examined in the print pattern of 100% duty shown in FIG. 7 printed after printing 30,000 pages of the print pattern of 5% duty shown in FIG. 6, and end portion smear P2 in both end portions of an image is examined in the half tone pattern of 40% duty shown in FIG. 8 printed after printing 30,000 pages of the print pattern of 5% duty shown in FIG. 6.

Note that in FIG. 12, a symbol ○ indicates the case where almost no white vertical stripe P1 or end portion smear P2 are visually recognizable. A symbol Δ indicates the case where white vertical stripe P1 or end portion smear P2 can be slightly visually recognized, and a symbol x indicates the case where white vertical stripe P1 or end portion smear P2 are visually recognizable. The symbols ○, Δ, and x are used below in the same meanings as those described above.

Processes of Evaluation 1 are described below.

30,000 pages of the print pattern of 5% duty shown in FIG. 6 are printed by using an image formation apparatus that includes development blade 15. The curvature radius R [mm] of contact portion 15*a* of development blade 15 with development roller 13=0.25 [mm]. Thereafter, the pattern of 100% duty shown in FIG. 7 and the print pattern of half tone of 40% duty shown in FIG. 8 are printed to evaluate the occurrence of print smears.

Here, the printing is performed in an environment in which the temperature is 22[° C.] and the humidity is 50[%]. Voltages applied to the respective members during the printing are as follows.

Development roller 13: −200 [V]

Supply roller 14: −300 [V]

Charge roller 12: −1100 [V]

Development blade 15: −300 [V]

The print speed of the used image formation apparatus is 38 [ppm] under the condition that one-side printing is performed on common plain paper sheets (basic weight of 68 to 75 [g/cm$^2$]).

As shown in FIG. 12, white vertical stripe P1 occurs more easily when the print pattern of 100% duty shown in FIG. 7 is printed by using supply roller 14 having a lower ASKER F hardness [°] (for example 40[°], 50[°]) before printing 30,000 pages of the print pattern of 5% duty (hereinafter, referred to as "initial ASKER F hardness"). End portion smear P2 occurs more easily when the print pattern of half tone of 40% duty shown in FIG. 8 is printed by using supply roller 14 having a higher initial ASKER F hardness [°] (for example 70[°], 80[°]).

White vertical stripe P1 is a phenomenon in which a portion of development roller 13 appears as a white stripe, the portion having no thin layer of toner T formed thereon due to an effect of foreign object 15*c* fixedly adhered to the portion (=edge portion) near contact portion 15*a* between development blade 15 and development roller 13.

Foreign object 15*c*, being the cause of white vertical stripe P1, is generated as follows. When the image formation apparatus performs the print operation for a long time period, elastic layer 14*b* of supply roller 14 wears due to the friction between supply roller 14 and development roller 13. A piece of sponge chipped off by this wear and toner T cling together by heat. The lower the initial ASKER F hardness [°] of supply roller 14, the more noticeable the occurrence of white vertical stripe P1. The reason for this is that the softer elastic layer 14*b* is, the larger the piece of sponge of supply roller 14 that is chipped off by the friction between supply roller 14 and development roller 13.

Contrary to the occurrence of white vertical stripe P1, the higher the initial ASKER F hardness [°] of supply roller 14, the worse the degree of smear. End portion smear P2 is caused by toner T triboelectrically charged in a nip between development roller 13 and supply roller 14 in printing.

The higher the ASKER F hardness [°] of supply roller 14 is, the more intense the triboelectric charging of toner T is, since the triboelectric charging is caused by pressure contact between development roller 13 and supply roller 14. Thus, the potential of the toner layer becomes higher, and end portion smear P2 occurs in an image. Specifically, in Embodiment 1, the crown ratio is 0.975 and there is no substantial difference in the outer diameter between end portions 14*c*, 14*e* and center portion 14*d* of supply roller 14. Accordingly, the pressure force between development roller 13 and supply roller 14 is strong in end portions 14*c*, 14*e* of supply roller 14 due to the effect of deflection in center portion 14*d*. Hence, the triboelectric charging of toner T is intense in end portions 14*c*, 14*e* and the smear in the image is significant in end portions 14*c*, 14*e*.

(2) Evaluation 2

Next, an evaluation is made of a relationship between the curvature radius R [mm] of contact portion 15*a* of development blade 15 and the occurrences of print smears.

FIG. 13 is a table showing the relationship between the curvature radius R [mm] of development blade 15 in FIG. 1 and the smears after printing 30,000 pages.

FIG. 13 shows a relationship between the curvature radius R [mm] of contact portion 15*a* of development blade 15 and each of white vertical stripe P1 and end portion smear P2 after printing 30,000 pages, in cases where the ASKER F hardness [°] of supply roller 14 is 40[°] and 60[°].

In Evaluation 2, the occurrences of white vertical stripe P1 and end portion smear P2 are evaluated for each combination of the curvature radius R [mm] of contact portion 15*a* of development blade 15=0.17 [mm], 0.20 [mm], . . . , 0.30 [mm] and the ASKER F hardness [°] of supply roller 14=40[°] and 60[°]. Other conditions for the evaluation are the same as those for Evaluation 1.

Evaluation results are shown in FIG. 13. As shown in FIG. 13, roughly no white vertical stripe P1 occurs when the curvature radius R [mm]=below 23 [mm] or smaller. In other words, large foreign object 15*c* is prevented from fixedly adhering to the portion near contact portion 15*a* of development blade 15 by making the curvature radius R [mm]

smaller. The adhering is effectively prevented, particularly when the ASKER F hardness [°] of supply roller 14 is small (for example, ASKER F hardness [°]=40[°]) and foreign object 15*c* adhering to the portion near contact portion 15*a* of development blade 15 is large. Accordingly, white vertical stripe P1 can be improved by making the curvature radius R [mm] of development blade 15 smaller.

However, although not shown in the table, when the curvature radius R [mm] is excessively reduced, the toner layer becomes extremely thin and density reduction occurs. This causes an afterimage or patchy printing. Thus, the curvature radius R [mm] cannot be unlimitedly reduced.

(3) Evaluation 3

In Evaluation 3, evaluations are made of occurrence statuses of white vertical stripe P1 and end portion smear P2 for each of combinations of the ASKER F hardness [°] of supply roller 14 and the curvature radius R [mm] of development blade 15.

FIG. 14 is a table showing the ASKER F hardnesses [°] of supply roller 14 in FIG. 1 and the curvature radiuses R [mm] of development blade 15 in FIG. 1, which are used in Evaluation 3.

FIG. 15 is a table showing combinations of the ASKER F hardness [°] of supply roller 14 and the curvature radius R [mm] of development blade 15 of FIG. 14, which are used in Evaluation 3.

Figure 16:
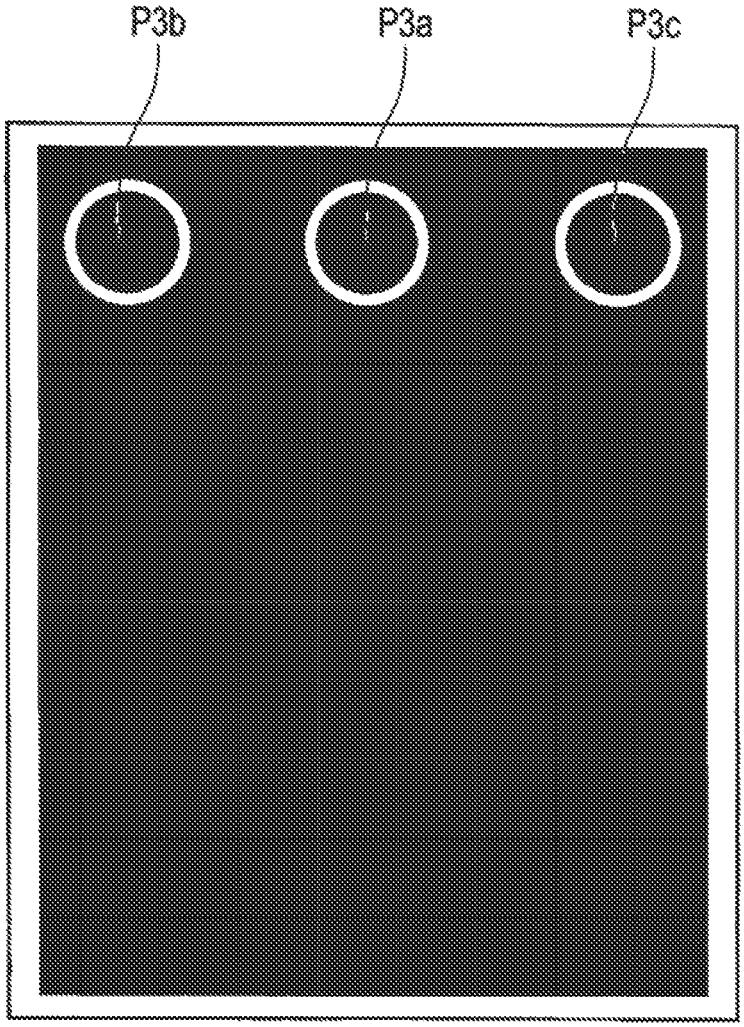
FIG. 16 shows density measurement positions in the print pattern of 100% duty.

FIG. 16 is a view showing density measurement positions P3*a*, P3*b*, P3*c* in the print pattern of 100% duty.

FIG. 17 is a table showing judgment results of smears and the combinations of the curvature radius R [mm] and the ASKER F hardness [°] of FIG. 14.

FIG. 17 shows occurrence statuses (judgment results) of white vertical stripe P1 and end portion smear P2 for each combination of the ASKER F hardness [°] of supply roller 14 of 35[°], 40[°], 45[°], . . . , 80[°], and 85[°] and the curvature radius R [mm] of development blade 15 of 0.14, 0.15, 0.17, . . . , 0.28, 0.30. Here, white vertical stripe P1 is examined in the print pattern of 100% duty shown in FIG. 7, printed after printing 30,000 pages of the print pattern of 5% duty shown in FIG. 6. Also, end portion smear P2 in both end portions of the image is examined in the half tone pattern of 40% duty shown in FIG. 8 printed after printing 30,000 pages of the print pattern of 5% duty shown in FIG. 6.

Symbols ○, Δ, and x in FIG. 17 have the same meaning as those in the descriptions for FIG. 13. A black solid triangle means that almost no white vertical stripe P1 and end portion smear P2 are visually recognizable, but a print density in the print pattern of 100% duty is below a predetermined value. The symbol of the black solid triangle is used in the same meanings hereafter.

Figure 18:
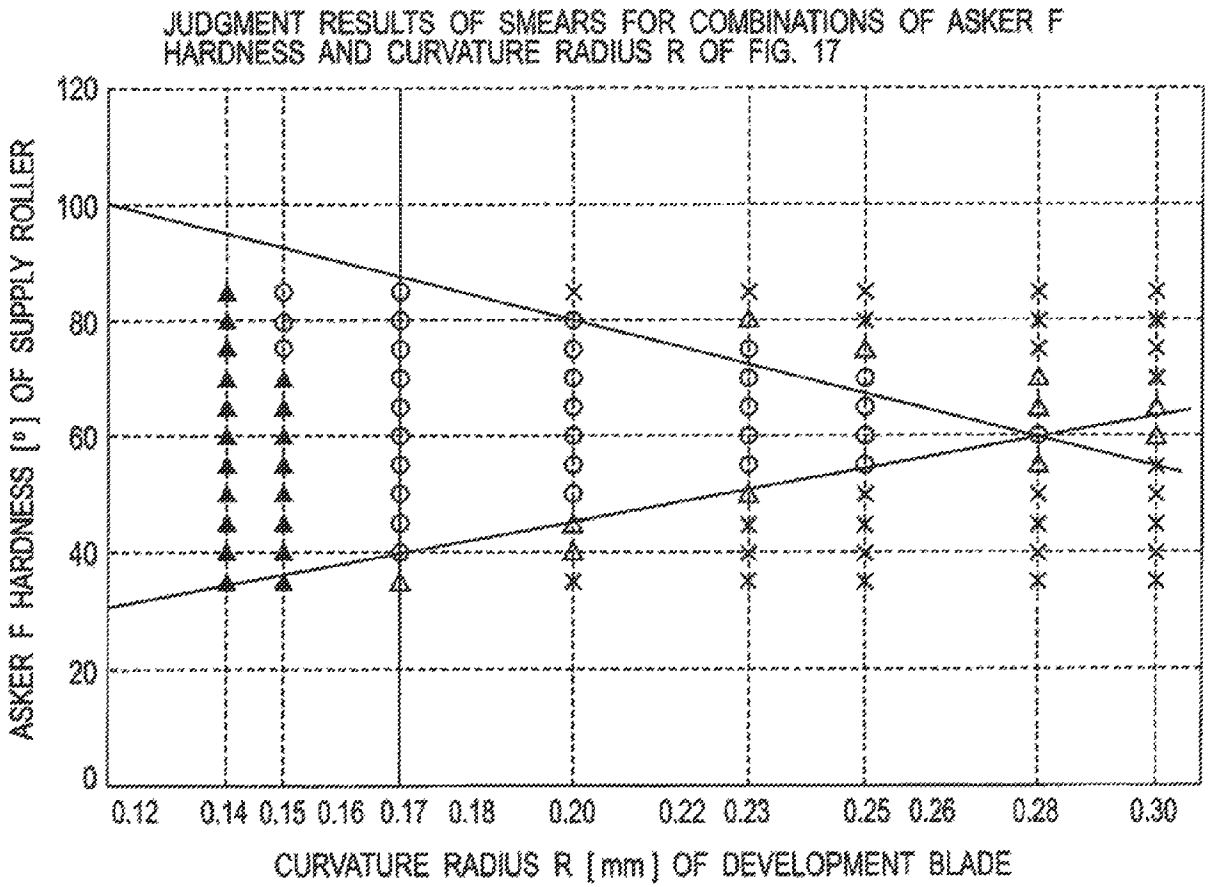
FIG. 18 is a graph showing the judgment results of smears for each combination of the ASKER F hardness and the curvature radius R.

FIG. 18 is a graph showing the judgment results of smears for each combination of the ASKER F hardness [°] and the curvature radius R [mm] of FIG. 17.

The horizontal axis indicates the curvature radius R [mm] of development blade 15 and the vertical axis indicates the ASKER F hardness [°] of supply roller 14.

A region inside a triangle shown in solid lines in the graph of FIG. 18 is a region in which almost no white vertical stripe P1 and end portion smear P2 are visually recognizable. When the curvature radius R [mm]=0.15, excellent printing results are obtained in cases where the ASKER F hardness [°]=75[°], 80[°], 85[°]. However, the print density is insufficient in cases where the ASKER F hardness [°] is 70[°] or lower. When the curvature radius R [mm]=0.14, the print density is insufficient in all plots.

Evaluation conditions in Evaluation 3 are as follows.

Ratio of outer diameter L1 of end portions 14*c*, 14*e* to outer diameter L2 of center portion 14*d* of supply roller 14=about 0.975.

Partial resistance value [log Ω] of supply roller 14=7 [log Ω].

Shape of development roller 13: straight shape.

Ten-point mean roughness Rz of development roller 13: 4 [μm]

Used image formation apparatuses: ML9600PS manufactured by Oki Electric Co., Ltd.

Used toner T: finely milled toner with a particle size of about 6 [μm].

Here, the printing is performed in an environment in which the temperature is 22[° C.] and the humidity is 50[%]. Voltages applied to the respective members during the printing are as follows.

Charge roller 12: −1100 [V]

Development roller 13: −200 [V]

Supply roller 14: −300 [V]

Development blade 15: −300 [V]

The evaluation is performed in the following procedure. The image formation apparatus (ML9600PS) using supply roller 14 and development blade 15 in the combinations of FIG. 15 described above is used to print 30,000 pages of the print pattern of 5% duty. Then, the image formation apparatus prints the print pattern of 100% and the print pattern of the half tone of 40% duty.

After the printing, densities are measured at density measurement positions P3*a*, P3*b*, P3*c* in the print pattern of 100% duty which are shown in FIG. 16. The densities are measured in the following way. X-Rite 500 spectrodensitometer, manufactured by X-Rite Incorporated, is used to measure optical density (hereinafter, referred to as "OD") values and an average of the three points is calculated.

Here, the densities are measured for the following reason. When the curvature radius R [mm] of development blade 15 is made smaller, the toner layer formed by development blade 15 becomes thin, and this causes image problems, such as an afterimage and a patchy image. Thus, the OD value is used as one of indexes. An allowable range of OD value ρ is set to be 1.20≤ρ from results of an evaluation. When OD value ρ exceeds 1.2, a printed output image of an image to be printed in 100% duty is actually outputted in duty of 80% or more. When the printed output image of 80% duty or more is viewed, there is no strangeness compared to the image of 100% duty in density difference. Accordingly, the allowable range of OD value ρ is set to be 1.20≤ρ.

As described above, FIG. 18 is a graph showing the results of judgment of smear for each combination of the ASKER F hardness [°] and the curvature radius R [mm] of FIG. 17.

The horizontal axis indicates the curvature radius R [mm] of development blade 15 and the vertical axis indicates the ASKER F hardness [°] of supply roller 14.

In the graph of FIG. 18, the region inside the triangle shown in solid lines is a region in which almost no white vertical stripe P1 and end portion smear P2 are visually recognizable. When the curvature radius R [mm]=0.15, excellent printing results are obtained in the cases where the ASKER F hardness [°]=75[°], 80[°], 85[°]. However, in the cases where the ASKER F hardness [°] is 70[°] or lower, ρ≤1.2 (insufficient print density). When the curvature radius R [mm]=0.14, ρ≤1.2 in all of the cases. As a result, it is found that the curvature radius R [mm]=0.15 is such a region that an excellent OD value can not be stably obtained and the print density is insufficient. Accordingly, the lower limit of the curvature radius R [mm] is determined to be 0.17.

This result is expressed using formulae as described below.

$0.17\ [mm] \leq R\ [mm] \leq 0.28\ [mm]$ $181.82[°] \times R\ [mm] + 9.09[°] \leq F[°] \leq -250[°] \times R\ [mm] + 130\ [°]$ where R [mm] is the curvature radius of contact portion 15*a* of development blade 15 and F[°] is the ASKER F hardness of supply roller 14.

Effects of Embodiment 1

In development device 10 and the image formation apparatus of Embodiment 1, development device 10 includes such members that the relationship between the ASKER F hardness [°] of elastic layer 14*b* of supply roller 14 and the curvature radius R [mm] of development blade 15 is a combination of:

$0.17\ [mm] \leq R\ [mm] \leq 0.28\ [mm]$, $181.82[°] \times R\ [mm] + 9.09[°] \leq F[°] \leq -250[°] \times R\ [mm] + 130\ [°]$. Accordingly, both of white vertical stripe P1 and end portion smear P2 can be avoided when a large amount of printing is performed for a long time period.

Embodiment 2

Configuration of the Image Formation Apparatus of Embodiment 2

The configuration of the image formation apparatus of Embodiment 2 is almost the same as that of Embodiment 1. Differences between Embodiment 2 and Embodiment 1 are described below.

As shown in FIG. 4A, the shape of supply roller 14 used in Embodiment 1 is a crown shape in which outer diameter L1 of end portions 14*c*, 14*e* in the longitudinal direction is smaller than outer diameter L2 of center portion 14*d*. The image formation apparatus of Embodiment 1 includes such supply roller 14 that the ratio of outer diameter L1 of end portions 14*c*, 14*e* to outer diameter L2 of center portion 14*d* is about 0.975.

Meanwhile, in the image formation apparatus of Embodiment 2, this ratio is referred to as a crown ratio B, and the image formation apparatus includes supply roller 14 whose crown ratio B is changed.

Note that, since the crown ratio B=L1/L2, an increase of the crown ratio B means that the difference between outer diameter L1 and outer diameter L2 becomes smaller. When the crown ratio B=1, outer diameter L1=outer diameter L2. On the other hand, a decrease of the crown ratio B means that the difference between outer diameter L1 and outer diameter L2 becomes larger.

Operation of Embodiment 2

The operation of the image formation apparatus of Embodiment 2 is the same as that of Embodiment 1.

Evaluation of Print Smears in Embodiment 2

In development device 10, nipping is performed by development roller 13 and supply roller 14 with a certain distance between the axes thereof. Here, a balance between a nip amount at end portions 14*c*, 14*e* and a nip amount at center portion 14*d* is important to form an image.

FIG. 19 is a table showing a relationship between the crown ratio B of supply roller 14 in FIG. 1 and nip widths [mm].

FIG. 19 shows results of measurement of the nip widths [mm] when a load of 360 [gf] is applied to supply roller 14, which is a condition same as that when supply roller 14 and development roller 13 are performing nipping in development device 10. As shown in FIG. 19, as the crown ratio B increases, an end portion nip width [mm] increases and a center nip width decreases [mm]. On the contrary, as the crown ratio B decreases, the end portion nip width [mm] decreases and the center nip width [mm] increases.

Supply roller 14 used in Embodiment 1 has the crown ratio B=0.975. As shown in FIG. 19, in this shape, the end portion nip width [mm] is large with respect to the center nip width [mm]. Thus, the triboelectric charging of toner T in end portions 14*c*, 14*e* is intense, and this causes end portion smear P2.

Furthermore, a wear amount of supply roller 14 tends to increase in a portion where a force of nipping between development roller 13 and supply roller 14 is strong.

FIG. 20 is a table showing the crown ratios of FIG. 19 and outer diameter change ratios of the supply roller 14.

FIG. 20 shows a change ratio of the outer diameter of end portions 14*c*, 14*e* before printing 30,000 pages to the outer diameter of end portions 14*c*, 14*e* after printing 30,000 pages, for each the crown ratio B, and compares them.

It can be seen from FIG. 20 that the end portion wear amount of supply roller 14 tends to decrease as the crown ratio B decreases.

In other words, pieces generated by the wear of supply roller 14 can be reduced by reducing the crown ratio B of supply roller 14. Accordingly, it is possible to reduce the amount of foreign object 15*c* which is generated by printing and which fixedly adheres to a portion near contact portion 15*a* of development blade 15 with development roller 13. This eventually leads to improvement of white vertical stripe P1 and to improvement of an image quality.

FIG. 21 is a table showing a relationship between the crown ratio B of FIG. 19 and the smears.

FIG. 21 shows a relationship between the crown ratio B of supply roller 14 and white vertical stripe P1, and a relationship between the crown ratio B and end portion smear P2. Used supply roller 14 has a partial resistance value A [log Ω] of 7.00 [log Ω] and the ASKER F hardness [°] of 50[°], and the curvature radius R [mm] of development blade 15 is 0.23 [mm]. Improvements can be seen in both white vertical stripe P1 and end portion smear P2 by reducing the crown ratio B.

FIG. 22 is a table showing judgment results of smears for combinations of the asker hardness and the curvature radius R when L1/L2=0.962.

Figure 23:
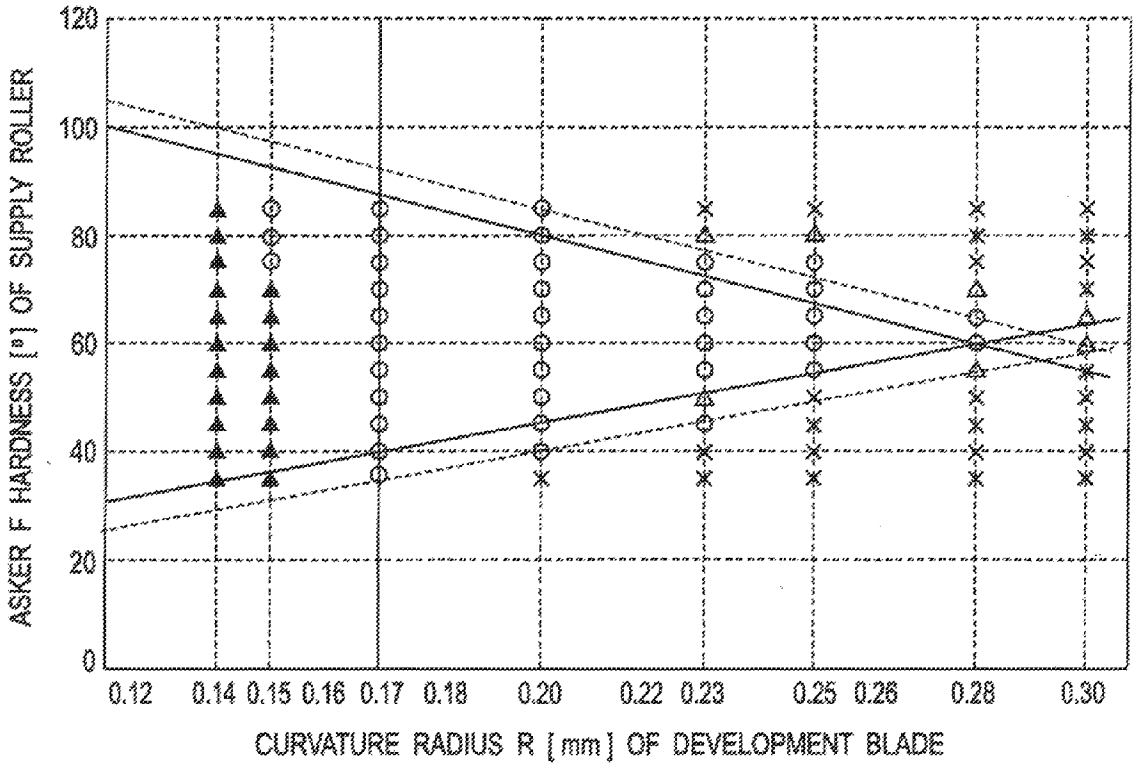
FIG. 23 is a graph showing the judgment results of smears for each of the combinations of the asker F hardness and the curvature radius R.

FIG. 23 is a graph showing the judgment results of smears for the combinations of the asker hardness and the curvature radius R of FIG. 22.

The horizontal axis indicates the curvature radius R [mm] of development blade 15 and the vertical axis indicates the ASKER F hardness [°] of supply roller 14.

The crown ratio B of supply roller 14 is changed little by little as shown in FIG. 21 for each of the combinations of the ASKER F hardness [°] of supply roller 14 and the curvature radius R [mm] of development blade 15, which are shown in FIG. 15 used in Embodiment 1. Then, as in Embodiment 1, comparative evaluations of white vertical stripe P1 and end portion smear P2 are performed. The results are shown in FIG. 23. Reducing crown ratio B to 0.962 broadens a range in which white vertical stripe P1 and end portion smear P2 are at satisfactory levels to a range shown by broken lines in FIG. 23.

However, when the crown ratio B is 0.936 or lower, there is such an adverse effect that "fogging," which is not illustrated, becomes notable on a paper sheet. When the crown ratio B is larger than 1, a smear occurs which is caused by an intensified triboelectric charging in the end portions of supply roller 14 and the end portions of development roller 13. Furthermore, the life of supply roller 14 is significantly reduced since friction in the end portion thereof is large. The satisfactory-level range of the crown ratio B is set in consideration of these adverse effects. When the conditions at which that white vertical stripe P1 and end portion smear P2 are not noticeable after printing 30,000 pages are determined in consideration of these adverse effects, the satisfactory-level range is expressed by the following formulae.

$$0.17\ [\mathrm{mm}] \leq R\ [\mathrm{mm}] \leq 0.28\ [\mathrm{mm}].$$

$$0.962 \leq B < 1.$$

$$181.82[°] \times R\ [\mathrm{mm}] + 9.09[°] + 5 \times (L1/L2 - 0.975)/0.013 \leq F[°] \leq -250[°] \times R\ [\mathrm{mm}] + 130[°] + 5 \times (0.975 - L1/L2)/0.013.$$

where R [mm] is the curvature radius R of development blade 15, F is the ASKER F hardness [°] of supply roller 14, and B is the crown ratio B.

Effects of Embodiment 2

In Embodiment 2, the ratio of outer diameter L1 of end portions 14*c*, 14*e* to outer diameter L2 of center portion 14*d* of supply roller 14 is made small. Thus, the pressure force between development roller 13 and supply roller 14 in end portions 14*c*, 14*e* is reduced, and the wear amount of supply roller 14 in printing is reduced. Accordingly, the amount of foreign object 15*c* adhering to the portion near contact portion 15*a* of development blade 15 with development roller 13 is reduced, and occurrence of white vertical stripe P1 is prevented. Moreover, since the pressure force between development roller 13 and supply roller 14 in end portions 14*c*, 14*e* is reduced, the triboelectric charging of toner T becomes milder, and end portion smear P2 is also improved.

The range in which white vertical stripe P1 and end portion smear P2 are at the satisfactory levels is expressed by the following formulae.

$$0.17\ [\mathrm{mm}] \leq R\ [\mathrm{mm}] \leq 0.28\ [\mathrm{mm}]$$

$$0.962 \leq B < 1$$

$$181.82[°] \times R\ [\mathrm{mm}] + 9.09[°] + 5 \times (L1/L2 - 0.975)/0.013 \leq F[°] \leq -250[°] \times R\ [\mathrm{mm}] + 130[°] + 5 \times (0.975 - L1/L2)/0.013$$

where R [mm] is the curvature radius R of development blade 15, F is the ASKER F hardness [°] of supply roller 14, and B is the crown ratio B.

Embodiment 3

Configuration of Embodiment 3

The configuration of the image formation apparatus of Embodiment 3 is almost the same as that of Embodiment 1. Differences between Embodiment 3 and Embodiment 1 are described below.

The image formation apparatus of Embodiment 1 includes supply roller 14 whose partial resistance value A [log Ω] is 7.00 [log Ω]. However, the image formation apparatus of Embodiment 3 includes supply roller 14 whose partial resistance value A [log Ω] is changed.

Operation of Embodiment 3

The operation of the image formation apparatus of Embodiment 3 is the same as that of Embodiment 1.

Evaluation of Print Smears in Embodiment 3

The partial resistance value A [log Ω] of supply roller 14 used in Embodiment 1 is 7.00 [log Ω]. However, in Embodiment 3, the partial resistance value A [log Ω] of supply roller 14 is changed, and a relationship between the partial resistance value A [log Ω] and smears on a printed image is evaluated.

FIG. 24 is a table showing the relationship between the partial resistance value A [log Ω] of supply roller 14 in FIG. 1 and the smears.

In FIG. 24, the ASKER F hardness [°] of supply roller 14 is 60[°], the curvature radius R [mm] of development blade 15 is 0.20 [mm], and the crown ratio B is 0.975. As shown in FIG. 24, the higher the partial resistance value A [log Ω] is, the worse white vertical stripe P1 is. Meanwhile, the lower the partial resistance value A [log Ω] is, the worse end portion smear P2 is.

The partial resistance value A [log Ω] of supply roller 14 is changed little by little as shown in FIG. 24 for each of the combinations of the ASKER F hardness [°] of supply roller 14 and the curvature radius R [mm] of development blade 15, which are shown in FIG. 15 used in Embodiment 1. Then, as in Embodiment 1, white vertical stripe P1 and end portion smear P2 are evaluated.

FIG. 25 is a table showing judgment results of smears for combinations of the ASKER hardness and the curvature radius R when A [log Ω]=8.0 [log Ω].

Figure 26:
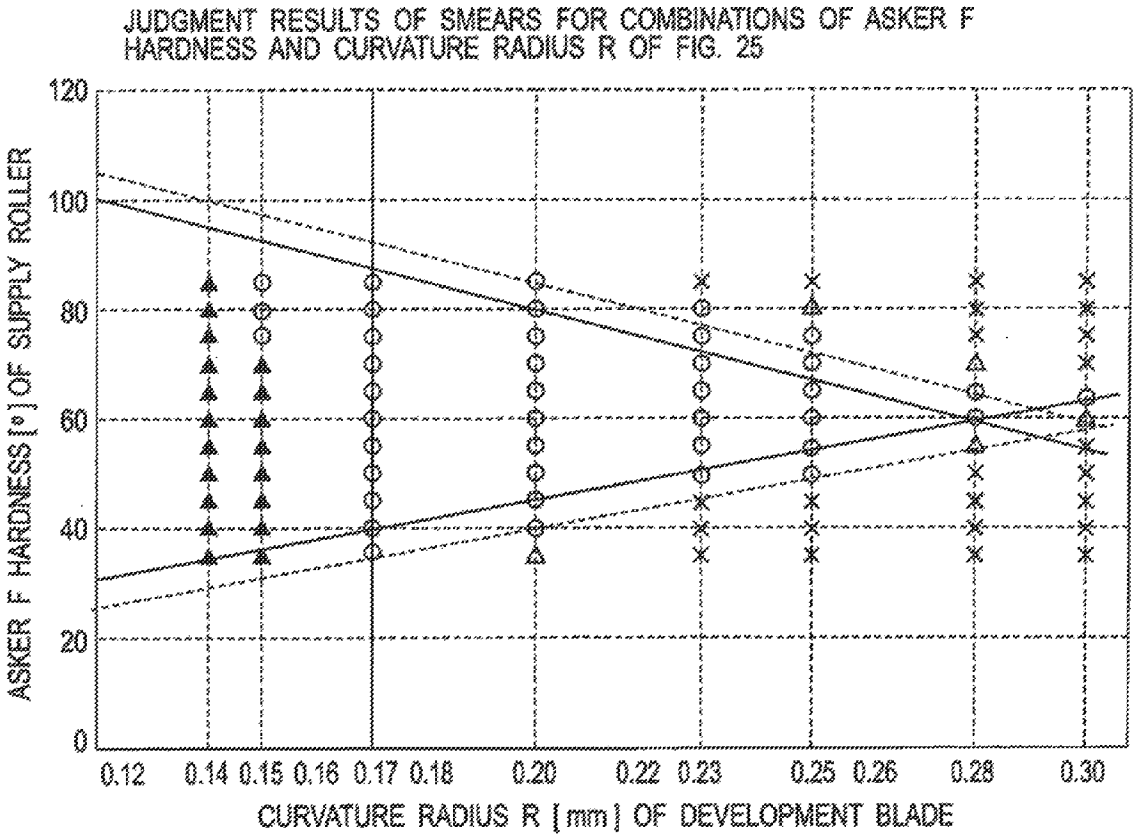
FIG. 26 is a graph showing the judgment results of smears for each of the combinations of the ASKER F hardness and the curvature radius R.

FIG. 26 is a graph showing the judgment result of smears for each of the combinations of the ASKER F hardness and the curvature radius R of FIG. 25.

The horizontal axis indicates the curvature radius R [mm] of development blade 15 and the vertical axis indicates the ASKER F hardness [°] J of supply roller 14.

The results of the evaluation are shown in FIG. 25. Increasing the partial resistance value A [log Ω] broadens a range in which white vertical stripe P1 and end portion smear P2 are at satisfactory levels to a region shown by broken lines. The broken lines show the case where the partial resistance value A [log Ω]=8.0.

However, when the partial resistance value A [log Ω] is larger than 8.00 [log Ω], there is such an adverse effect that fogging (not illustrated) becomes noticeable in a printed image. Moreover, when the partial resistance value A [log Ω] is smaller than 6.0 [log Ω], the supply amount of toner T from supply roller 14 to development roller 13 increases and, as a result, a smear occurs. The satisfactory-level range of the partial resistance value A is set in consideration of these adverse effects. When such conditions that white vertical stripe 21 and end portion smear P2 are prevented after printing 30,000 pages are obtained in consideration of the occurrence of fogging, the satisfactory-level range is expressed by the following formulae.

$$0.17\ [\mathrm{mm}] \leq R\ [\mathrm{mm}] \leq 0.28\ [\mathrm{mm}]$$

$$6.0\ [\log \Omega] \leq A\ [\log \Omega] \leq 8.00\ [\log \Omega]$$

$$181.82[°] \times R\ [mm] + 9.09[°] + 5 \times (7 - A\ [\log \Omega]) \leq F[°] \leq -250[°] \times R\ [\mathrm{mm}] + 130[°] + 5 \times (A\ [\log \Omega] - 7)$$

where R [mm] is the curvature radius R [mm] of development blade 15, F is the ASKER F hardness [°] of supply roller 14, and A is the partial resistance value A [log Ω].

Effects of Embodiment 3

In Embodiment 1, increasing the partial resistance value A [log Ω] of supply roller 14 is effective in improving end portion smear P2. The range in which white vertical stripe 21 and end portion smear P2 are at the satisfactory levels can be expressed by the following formulae.

$$0.17\ [\mathrm{mm}] \leq R\ [\mathrm{mm}] \leq 0.28\ [\mathrm{mm}]$$

$$6.0\ [\log \Omega] \leq A\ [\log \Omega] \leq 8.00\ [\log \Omega]$$

$$181.82[°] \times R\ [\mathrm{mm}] + 9.09[°] + 5 \times (7 - A\ [\log \Omega]) \leq F[°] \leq -250[°] \times R\ [\mathrm{mm}] + 130[°] + 5 \times (A\ [\log \Omega] - 7)$$

where R [mm] is the curvature radius R [mm] of development blade 15, F is the ASKER F hardness [°] of supply roller 14, and A is the partial resistance value A [log Ω].

Embodiment 4

Configuration of Embodiment 4

Figure 27:
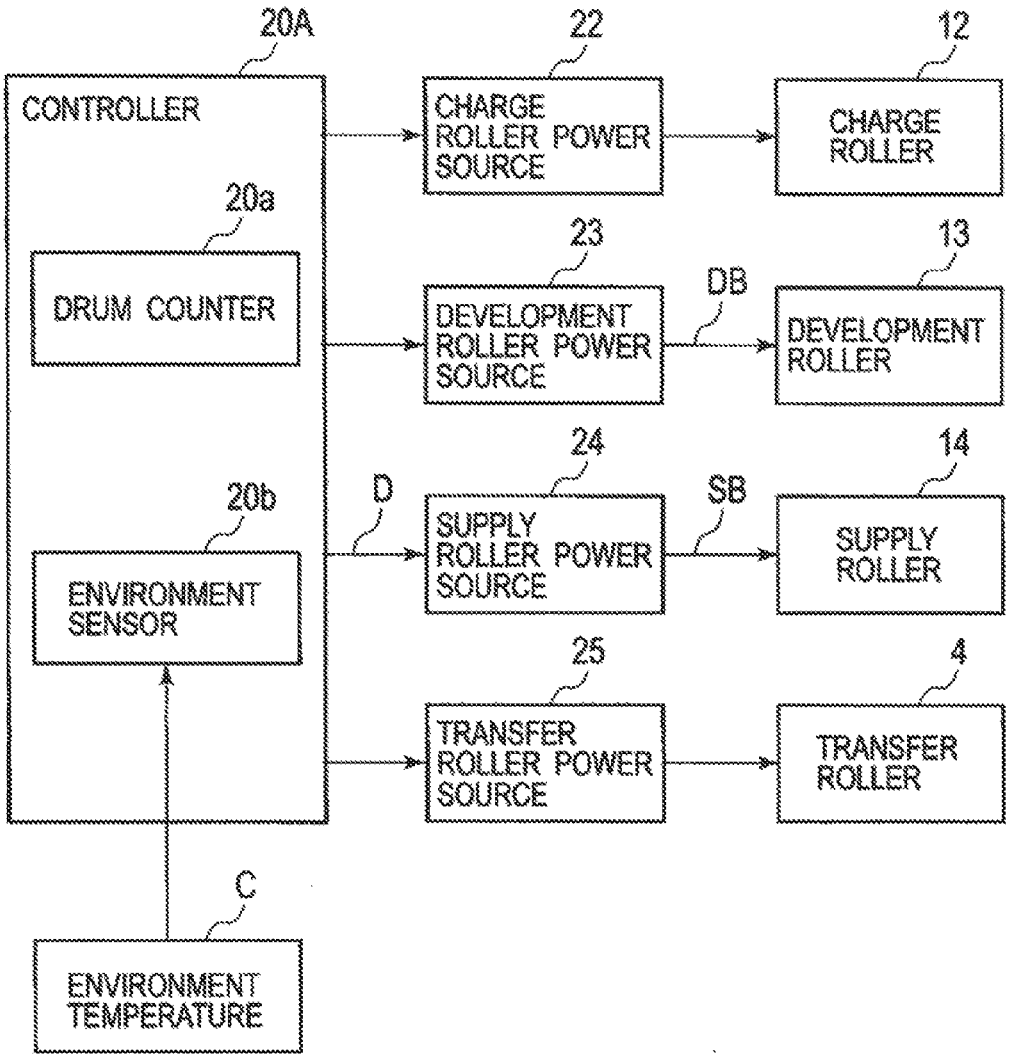
FIG. 27 is a block diagram illustrating components of the image formation apparatus according to Embodiment 4.

FIG. 27 is a block diagram illustrating components of an image formation apparatus according to Embodiment 4 of the invention. Elements which are the same as the elements in FIG. 3 illustrating Embodiment 1 are denoted with the same reference numerals.

The image formation apparatus of Embodiment 4 has almost the same configuration as the image formation apparatus of FIG. 3 illustrating Embodiment 1. The image formation apparatus of Embodiment 4 is different from the image formation apparatus of FIG. 3 illustrating Embodiment 1 in that environment sensor 20*b* configured to detect an environment temperature C [° C.] is additionally provided. Note that in Figures relating to Embodiment 4, a bias [V] applied to development roller 13, a bias [V] applied to supply roller 14, and a correction value [V] of the bias applied to supply roller 14 are denoted with DB, SB, and D, respectively, for the purpose of description.

Operation of Embodiment 4

Figure 28:
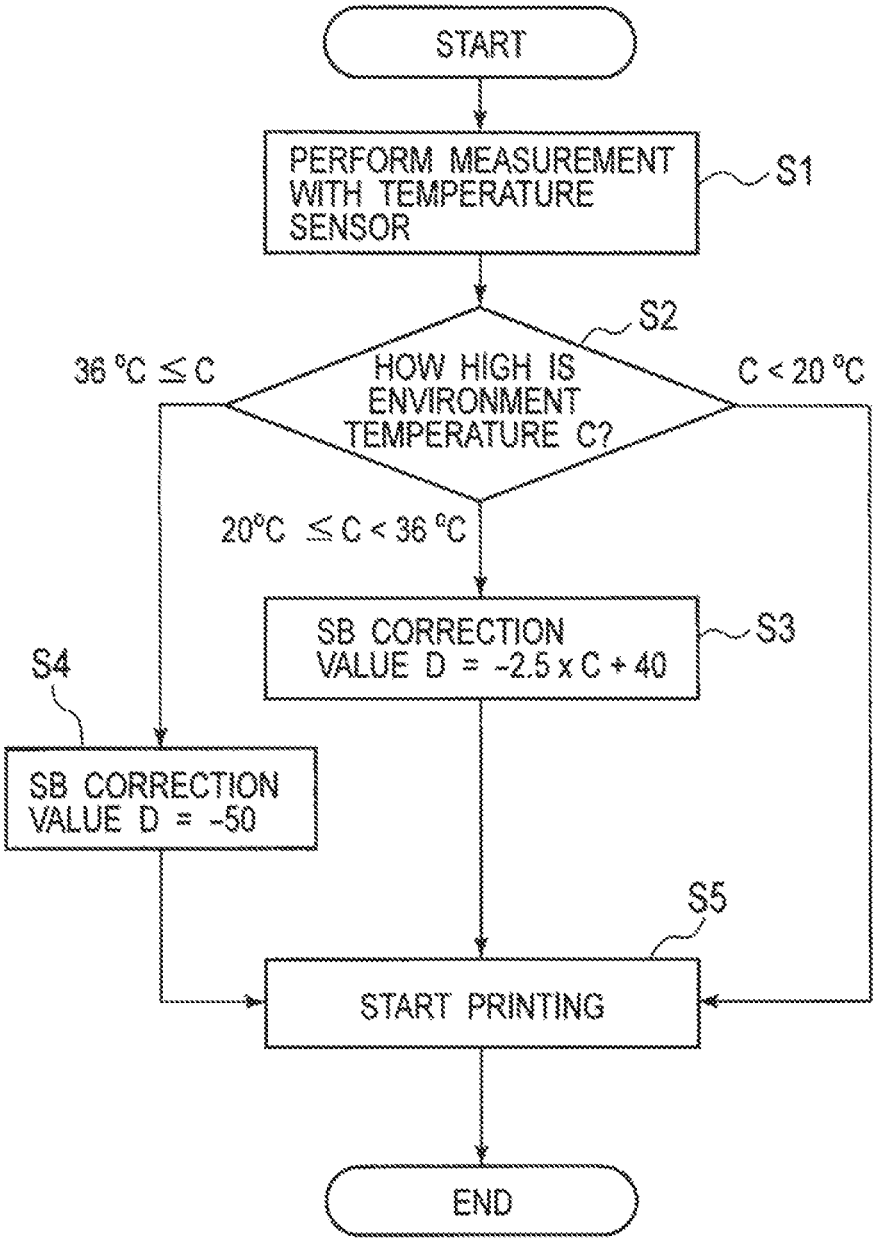
FIG. 28 is a flowchart illustrating a control sequence of bias voltage values SB and DB, as applied in the block diagram of FIG. 27.

FIG. 28 is a flowchart illustrating a control sequence of bias voltage vales SB and DB [V], as applied in the block diagram of FIG. 27.

The control sequence of the SB-DB value [V] applied to the block diagram of FIG. 27 is described using FIG. 28.

In step S1, controller 20A acquires the environment temperature C [° C.] by using environment sensor 20*b* (FIG. 27). In step S2, the process branches based on the acquired environment temperature C [° C.]. Specifically, the process proceeds to step S5 when the environment temperature C [° C.] is below 20° C., and the print operation is started in step S5. Then, the process is terminated when the print operation is completed.

The process proceeds to step S3 when the environment temperature C [° C.] is 20° C. or higher and is below 36° C. in step S2. In step S3, it is set such that a SB correction value D [V]=−2.5 [V]×C[° C.]+40 [V]. Then, the process proceeds to step S5. The process proceeds to step S4 when the environment temperature C [° C.] is 36° C. or higher in step S2. In step S4, it is set such that the SB correction value D [V]=−50 [V]. Then, the process proceeds to step S5.

The control sequence of the SB-DB value [V] of FIG. 28 is summarized as follows.

$$D\ [\mathrm{V}] = 0, \text{ when } C[°\ \mathrm{C.}] < 20°\ \mathrm{C.},$$

$$D\ [\mathrm{V}] = -2.5\ [\mathrm{V}] \times C[°\ \mathrm{C.}] + 40\ [\mathrm{V}], \text{ when } 20°\ \mathrm{C.} \leq C[°\ \mathrm{C.}] < 36°\ \mathrm{C.},$$

$$D\ [\mathrm{V}] = -50\ [\mathrm{V}], \text{ when } C[°\ \mathrm{C.}] \geq 36°\ \mathrm{C.}$$

An SB correction is performed when the environment temperature C [° C.] is 20[° C.] or higher, at which white vertical stripe P1 gets worse. When the environment temperature C [° C.] is 36[° C.] or higher, the SB correction value D [V] is set to −50 [V] being the lower limit of the SB correction value [V]. Note that the SB-DB value [V], being the reference of the correction, is −300−(−200)=−100 [V].

Evaluation of Print Smears in Embodiment 4

In Embodiment 4, a relationship between values of voltages applied to development roller 13 and supply roller 14 and white vertical stripe P1 and a relationship between the values of voltages and end portion smear P2 are evaluated. Here, the bias applied to development roller 13 is denoted with DB [V], and the bias applied to supply roller 14 is denoted with SB [V].

FIG. 29 is a table showing relationships between the SB-DB value in FIG. 27 and the smears.

FIG. 29 shows occurrence statuses of white vertical stripe P1 and end portion smear P2 when the SB-DB value [V] is changed within a range of −25 [V] to −225 [V], under the following condition. The ASKER F hardness [°] of used supply roller 14=60 [°], the curvature radius R [mm] of contact portion 15*a* of development blade 15=0.20 [mm], and the partial resistance value A [log Ω]=7.00 [log Ω].

As shown in FIG. 29, white vertical stripe P1 occurs at −25 [V] and −50 [V], and end portion smear P2 occurs at −175 [V], −200 [V], and −225 [V].

End portion smear P2 occurs due to the following reason. Toner T used in Embodiment 4 is a negatively charged developer.

Thus, the larger the potential difference between supply roller 14 and development roller 13 is in the negative direction, the more the amount of toner T moves from supply roller 14 to development roller 13. Accordingly, the higher the absolute value of the SB-DB value [V] is, the thicker the toner layer formed on the development roller 13 is. When the thickness of the toner layer exceeds an allowable amount, end portion smear P2 is likely to occur in a printed image.

Meanwhile, the following can be said for white vertical stripe P1. As the absolute value of the SB-DB value [V] increases, the toner layer formed on development roller 13 becomes thicker. Thus, even if foreign object 15*c* fixedly adheres to the portion near contact portion 15*a* of development blade 15 with development roller 13, the difference in the amount of toner T between a portion where foreign object 15*c* exists and a portion where no foreign object 15*c* exists becomes smaller. As a result white vertical stripe P1 is made less noticeable.

FIG. 30 is a table showing a relationship between the environment temperature C [° C.] in FIG. 27 and the smear.

In FIG. 30, the partial resistance value A [log Ω] of used supply roller 14 is 7.00 [log Ω] and the ASKER F hardness [°] of supply roller 14 is 60[°], the crown ratio B is 0.975, and the curvature radius R [mm] of development blade 15 is 0.20 [mm]. As shown in FIG. 30, white vertical stripe P1 occurs at a high temperature of 24° C. or higher. The higher the environment temperature C [° C.] is, the larger the amount of fixedly adhering foreign object 15*c* is.

Meanwhile, as described above, it is known that occurrence of white vertical stripe P1 can be avoided by increasing the absolute value of the SB-DB value [V]. Thus, it is expected that white vertical stripe P1 can be avoided by increasing the absolute value of the SB-DB value [V] in a high temperature environment. In this case, if the absolute value of the SB-DB value [V] is excessively increased, end portion smear P2 becomes worse as shown in FIG. 29.

FIG. 31 is a table showing a relationship between the environment temperature C [° C.] in FIG. 27 and the SB correction value D [V]. FIG. 32 is a table showing combinations of the curvature radius R [mm] of development blade 15 of FIG. 27 and the ASKER F hardness [°] of supply roller 14 of FIG. 27. FIG. 33 is a table showing statuses of the smear in each of the combinations of FIG. 32 without SB-DB control sequence. FIG. 34 is a table showing statuses of the smear in each of the combinations of FIG. 32 with the SB-DB control sequence.

Next, supply roller 14 and development blade 15 under each combination of the conditions in FIG. 32 are evaluated as in Embodiment 1 by using an image formation apparatus by checking whether white vertical stripe P1 can be actually avoided. The image formation apparatus functions to control the SB-DB value [V] and outputting the SB correction value D [V] shown in FIG. 31 in accordance with the environment temperature C [° C.]. Note that all of the combinations of the curvature radius R [mm] of development blade 15, and the ASKER F hardness [°] of supply roller 14, are combinations in which white vertical stripe P1 occurs in Embodiment 1.

FIG. 33 shows occurrence statuses of the smear in the case where no SB-DB control sequence is performed. A smear occurs at environment temperatures C [° C.] of 28[C.°] and 36[C.°] when the curvature radius R [mm] of development blade 15=0.18 [mm] and the ASKER F hardness [°] of supply roller 14=38[°]. Similarly, A smear occurs at environment temperatures C [° C.] of 28[C.°] and 36[C.°] when the curvature radius R [mm] of development blade 15=0.20 [mm], 0.22 [mm] and the ASKER F hardness [°] of supply roller 14=41[°], 44[°]. A slight smear occurs at environment temperatures C [° C.] of 36[C.°] when the curvature radius R [mm] of development blade 15=0.24 [mm], 0.26 [mm] and the ASKER F hardness [°] of supply roller 14=50[°], 55[°].

Meanwhile, in the case where the SB-DB control sequence is performed, as shown in FIG. 34, no problems concerning white vertical stripe P1 and end portion smear P2 occur at all at the temperatures for all of the combinations of the curvature radius R [mm] of development blade 15 and the ASKER F hardness [°] of supply roller 14.

Effects of Embodiment 4

In embodiment 4, white vertical stripe P1 can be avoided to a certain degree by having an image formation apparatus provided with the function of controlling the SB-DB value [V] in accordance with the environment temperature C [° C.]. The SB correction value D [V] is obtained as follows.

$$D\,[\mathrm{V}]=0,\ \text{when } C[^\circ\,\mathrm{C.}]<20^\circ\,\mathrm{C.},$$

$$D\,[\mathrm{V}]=-2.5\,[\mathrm{V}]\times C[^\circ\,\mathrm{C.}]+40\,[\mathrm{V}],\ \text{when } 20^\circ\,\mathrm{C.}\leq C[^\circ\,\mathrm{C.}]<36^\circ\,\mathrm{C.},$$

$$D\,[\mathrm{V}]=-50\,[\mathrm{V}],\ \text{when } C[^\circ\,\mathrm{C.}]\geq 36^\circ\,\mathrm{C.},$$

where C [° C.] is the environment temperature C [° C.], D [V] is the SB correction value D [V].

Modified Example

The invention is not limited to the embodiments described above, and various utilization modes and modifications are allowed. Examples of such utilization modes and modifications include (a) and (b) described below.

(a) The page printer is given as an example of the image formation apparatus in the descriptions of Embodiments 1 to 4. However, the invention is not limited to this, and can be applied to a facsimile apparatus, a copier, a MFP (Multi-Function Printer/Product/Peripheral), and the like.

(b) The page printer of a tandem direct-print type is given as an example in the descriptions of Embodiments 1 to 4. However, the invention can be applied to an image formation apparatus of an intermediate-transfer type.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development device comprising:

an image carrier configured to develop an electrostatic latent image by using a developer;

a development member configured to supply the developer to the image carrier;

a developer supply member configured to supply the developer onto a surface of the development member; and a developer restriction member including a contact portion configured to form a developer layer on the surface of the development member while being in contact with the surface, wherein a curvature radius R [mm] of the contact portion of the developer restriction member is 0.17 [mm] to 0.28 [mm], both inclusive, and an ASKER F hardness [°] of the developer supply member is $$181.82\times R+9.09\leq F\leq -250\times R+130,$$

wherein the developer supply member has an almost columnar shape, and the developer supply member satisfies $0.962\leq L1/L2\leq 1$, where L1 is an outer diameter of the developer supply member in an portion near an end in a longitudinal direction, and L2 is an outer diameter thereof in a center portion in the longitudinal direction.

2. The development device according to claim 1, wherein the ASKER F hardness [°] of the developer supply member is $$181.82\times R+9.09+5\times(L1/L2-0.975)/0.013\leq F\leq -250\times R+130+5\times(0.975-L1/L2)/0.013.$$

3. The development device according to claim 1, wherein the developer supply member is configured to supply the developer to the development member when a predetermined bias voltage is applied thereto, and the development device is provided with a voltage control member configured to control the bias voltage in accordance with a temperature C [C.°] of a print environment.

4. The development device according to claim 3, wherein the voltage control member controls an applied correction voltage value, D [V], of the bias voltage applied to the developer supply member in accordance with the temperature C[C.°] of the print environment, in such a way that $$D\,[\mathrm{V}]=0,\ \text{when } C\,[\mathrm{C.}^\circ]<20\,[\mathrm{C.}^\circ],$$

$$D\,[\mathrm{V}]=-2.5\,[\mathrm{V}]\times C\,[\mathrm{C.}^\circ]+40\,[\mathrm{V}],\ \text{when } 20\,[\mathrm{C.}^\circ]\leq C\,[\mathrm{C.}^\circ]<36\,[\mathrm{C.}^\circ],$$

$$D\,[\mathrm{V}]=-50\,[\mathrm{V}],\ \text{when } C\,[^\circ\,\mathrm{C.}]\geq 36\,[^\circ\,\mathrm{C.}].$$

5. The development device according to claim 1, wherein the developer supply member is a supply roller configured to rotate in contact with the development member and to supply the developer to the development member.

6. The development device according to claim 5, wherein the supply roller is a sponge roller.

7. The development device according to claim 6, wherein the sponge roller includes a first metal core portion being a conductive shaft and a conductive foam layer formed around the first metal core portion.

8. The development device according to claim 7, wherein the foam layer is made of a silicone rubber.

9. The development device according to claim 1, wherein the development member is a development roller facing the image carrier and configured to supply the developer supplied from a supply roller to the image carrier.

10. The development device according to claim 9, wherein the development roller includes a second metal core portion being a conductive shaft, an elastic layer formed around the second metal core portion, and a process layer formed on a surface of the elastic layer and processed to be electrifiable and to have a certain roughness.

11. The development device according to claim 10, wherein the elastic layer is made of a polyurethane rubber.

12. The development device according to claim 1, wherein a partial resistance value A [log Ω] of the developer supply member is 6.00 [log Ω] to 8.00 [log Ω], both inclusive.

13. The development device according to claim 12, wherein the ASKER F hardness [°] of the developer supply member is $$181.82\times R+9.09+5\times(7-A)\leq F\leq -250\times R+130+5\times(A-7).$$

14. The development device according to claim 1, wherein the developer restriction member is a development blade formed by bending an elastic plate material into an almost L-shape.

15. The development device according to claim 1, wherein the developer restriction member is a development blade having one end fixed and the other end bent into an almost L-shape.

16. An image formation apparatus comprising:

the development device of claim 1;

a conveyance mechanism configured to convey a record medium;

a transfer portion configured to transfer the developer visualized by the development device to the record medium; and a fuse portion configured to fuse the developer transferred to the record medium.

17. A development device comprising:

an image carrier configured to develop an electrostatic latent image by using a developer;

a development member configured to supply the developer to the image carrier;

a developer supply member configured to supply the developer onto a surface of the development member; and a developer restriction member including a contact portion configured to form a developer layer on the surface of the development member while being in contact with the surface, wherein a curvature radius R [mm] of the contact portion of the developer restriction member is 0.17 [mm] to 0.28 [mm], both inclusive, and an ASKER F hardness [°] of the developer supply member is $$181.82\times R+9.09\leq F\leq -250\times R+130,$$

wherein a partial resistance value A [log Ω] of the developer supply member is 6.00 [log Ω] to 8.00 [log Ω], both inclusive.

18. The development device according to claim 17, wherein the ASKER F hardness [°] of the developer supply member is $$181.82\times R+9.09+5\times(7-A)\leq F\leq -250\times R+130+5\times(A-7).$$

19. The development device according to claim 17, wherein the developer supply member is configured to supply the developer to the development member when a predetermined bias voltage is applied thereto, and the development device is provided with a voltage control member configured to control the bias voltage in accordance with a temperature C [C.°] of a print environment.

20. The development device according to claim 19, wherein the voltage control member controls an applied correction voltage value, D [V], of the bias voltage applied to the developer supply member in accordance with the temperature C[C.°] of the print environment, in such a way that $$D\ [\mathrm{V}]=0,\ \text{when}\ C\ [\mathrm{C.°}]<20\ [\mathrm{C.°}],$$

$$D\ [\mathrm{V}]=-2.5\ [\mathrm{V}]\times C\ [\mathrm{C.°}]+40\ [\mathrm{V}],\ \text{when}\ 20\ [\mathrm{C.°}]\leq C\ [\mathrm{C.°}]<36\ [\mathrm{C.°}],$$

$$D\ [\mathrm{V}]=-50\ [\mathrm{V}],\ \text{when}\ C\ [°\ \mathrm{C.}]\geq 36\ [°\ \mathrm{C.}].$$

21. The development device according to claim 17, wherein the ASKER F hardness [°] of the developer supply member is $$181.82\times R+9.09+5\times(L1/L2-0.975)/0.013\leq F\leq -250\times R+130+5\times(0.975-L1/L2)/0.03,$$

where L1 is an outer diameter of the developer supply member in an portion near an end in a longitudinal direction, and L2 is an outer diameter thereof in a center portion in the longitudinal direction.

22. The development device according to claim 17, wherein the developer supply member is a supply roller configured to rotate in contact with the development member and to supply the developer to the development member.

23. The development device according to claim 22, wherein the supply roller is a sponge roller.

24. The development device according to claim 23, wherein the sponge roller includes a first metal core portion being a conductive shaft and a conductive foam layer formed around the first metal core portion.

25. The development device according to claim 24, wherein the foam layer is made of a silicone rubber.

26. The development device according to claim 17, wherein the development member is a development roller facing the image carrier and configured to supply the developer supplied from a supply roller to the image carrier.

27. The development device according to claim 26, wherein the development roller includes a second metal core portion being a conductive shaft, an elastic layer formed around the second metal core portion, and a process layer formed on a surface of the elastic layer and processed to be electrifiable and to have a certain roughness.

28. The development device according to claim 27, wherein the elastic layer is made of a polyurethane rubber.

29. The development device according to claim 17, wherein the developer restriction member is a development blade formed by bending an elastic plate material into an almost L-shape.

30. The development device according to claim 17, wherein the developer restriction member is a development blade having one end fixed and the other end bent into an almost L-shape.

31. An image formation apparatus comprising:

the development device of claim 17;

a conveyance mechanism configured to convey a record medium;

a transfer portion configured to transfer the developer visualized by the development device to the record medium; and a fuse portion configured to fuse the developer transferred to the record medium.

32. The development device according to claim 17, wherein the development supply member comprises a supply roller that has a crown shape.

* * * * *